US009725998B2

(12) United States Patent
East et al.

(10) Patent No.: US 9,725,998 B2
(45) **Date of Patent: *Aug. 8, 2017**

(54) MULTI-INTERVAL WELLBORE TREATMENT METHOD

(71) Applicant: Halliburton Energy Services, Inc., Houston, TX (US)

(72) Inventors: Loyd Eddie East, Tomball, TX (US); Sharlene Dawn Lindsay, Richmond, TX (US); Nicholas Hubert Gardiner, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 309 days.

This patent is subject to a terminal disclaimer.

(21) Appl. No.: 14/515,183

(22) Filed: Oct. 15, 2014

(65) Prior Publication Data

US 2015/0027692 A1 Jan. 29, 2015

Related U.S. Application Data

(63) Continuation of application No. 13/442,411, filed on Apr. 9, 2012, now Pat. No. 8,887,803, and a (Continued)

(51) Int. Cl.
*E21B 43/16* (2006.01)
*E21B 34/14* (2006.01)

(Continued)

(52) U.S. Cl.
CPC ..... *E21B 43/162* (2013.01); *E21B 29/08* (2013.01); *E21B 33/12* (2013.01); *E21B 34/14* (2013.01);

(Continued)

(58) Field of Classification Search
CPC ..... E21B 43/14; E21B 43/26; E21B 43/114; E21B 43/267; E21B 43/305; E21B 43/162; E21B 34/14; E21B 33/124; E21B 33/12

See application file for complete search history.

(56) References Cited

U.S. PATENT DOCUMENTS 4,949,788 A * 8/1990 Szarka ..... E21B 23/006 166/285
2003/0205376 A1* 11/2003 Ayoub ..... E21B 43/26 166/254.2

(Continued)

OTHER PUBLICATIONS

Office Action issued in related Canadian patent application No. 2,868,337, mailed on Jan. 12, 2016, 4 pages.

*Primary Examiner* — Robert E Fuller
*Assistant Examiner* — David Carroll
(74) *Attorney, Agent, or Firm* — Craig W. Roddy; Baker Botts L.L.P.

(57) ABSTRACT

A method of servicing a subterranean formation comprising providing a wellbore penetrating the subterranean formation and having a casing string disposed therein, the casing string comprising a plurality of points of entry, wherein each of the plurality of points of entry provides a route a fluid communication from the casing string to the subterranean formation, introducing a treatment fluid into the subterranean formation via a first flowpath, and diverting the treatment fluid from the first flowpath into the formation to a second flowpath into the formation.

20 Claims, 14 Drawing Sheets

Related U.S. Application Data continuation-in-part of application No. 12/358,079, filed on Jan. 22, 2009, now Pat. No. 8,960,292.

(51) Int. Cl.

| | |
|---|---|
| ***E21B 43/267*** | (2006.01) |
| ***E21B 29/08*** | (2006.01) |
| ***E21B 33/12*** | (2006.01) |
| ***E21B 43/114*** | (2006.01) |
| ***E21B 43/14*** | (2006.01) |
| ***E21B 47/00*** | (2012.01) |

(52) U.S. Cl.

CPC ..... *E21B 43/114* (2013.01); *E21B 43/14* (2013.01); *E21B 43/267* (2013.01); *E21B 47/00* (2013.01)

(56) References Cited

U.S. PATENT DOCUMENTS

| | | | | |
|---|---|---|---|---|
| 2010/0044041 | A1 | 2/2010 | Smith et al. | |
| 2010/0044102 | A1* | 2/2010 | Rinzler ..... | E21B 7/14 175/15 |

* cited by examiner

MULTI-INTERVAL WELLBORE TREATMENT METHOD

CROSS-REFERENCE TO RELATED APPLICATIONS

This application is a continuation of and claims priority to U.S. patent application Ser. No. 13/442,411 filed Apr. 9, 2012 by East, et al., published as US 2013/0264054 A1 and entitled "Multi-Interval Wellbore Treatment Method," which is incorporated herein by reference in its entirety.

This application is also a continuation-in-part of and claims priority to U.S. application Ser. No. 12/358,079 to Malcolm Joseph Smith, et al., filed on Jan. 22, 2009, and entitled "High Rate Stimulation Method for Deep, Large Bore Completions," which is incorporated herein in its entirety.

This application is related to commonly owned U.S. patent application Ser. No. 12/566,467 filed Sep. 24, 2009 by East, et al., now U.S. Pat. No. 8,439,116 and entitled "Method for Inducing Fracture Complexity in Hydraulically Fractured Horizontal Well Completions." This application is also related to commonly owned U.S. patent application Ser. No. 13/403,423 filed Feb. 23, 2012 by East, published as US 2012/0152550 A1 and entitled "Method for Inducing Fracture Complexity in Hydraulically Fractured Horizontal Well Completions." This application is also related to commonly owned U.S. patent application Ser. No. 13/892,710 filed May 13, 2013 by East, et al., now U.S. Pat. No. 8,733,444 and entitled "Method for Inducing Fracture Complexity in Hydraulically Fractured Horizontal Well Completions." This application is also related to commonly owned U.S. patent application Ser. No. 12/686,116 filed Jan. 12, 2010 by East, now U.S. Pat. No. 8,631,872 and entitled "Complex Fracturing Using a Straddle Packer in a Horizontal Wellbore." This application is also related to commonly owned U.S. patent application Ser. No. 14/106,323 filed Dec. 13, 2013 by East, published as US 2014/0096968 A1 and entitled "Complex Fracturing Using a Straddle Packer in a Horizontal Wellbore." This application is also related to commonly owned U.S. patent application Ser. No. 13/567,953 filed Aug. 6, 2012 by Surjaatmadja, et al., published as US 2014/0034319 A1 and entitled "Method and Wellbore Servicing Apparatus for Production Completion of an Oil and Gas Well." This application is also related to commonly owned U.S. patent application Ser. No. 13/754,397 filed Jan. 30, 2013 by Modeland and entitled "Wellbore Servicing Fluids and Methods of Making and Using Same."

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

In some wellbores, it may be desirable to selectively create multiple fractures along a wellbore at a distance apart from each other, accessing multiple "pay zones." The multiple fractures should each have adequate conductivity, so that the greatest possible quantity of hydrocarbons in an oil and gas reservoir can be produced from the wellbore. Some pay zones may extend a substantial distance along the length of a wellbore.

In order to adequately induce the formation of fractures within such zones in an efficient manner, it may be advantageous to introduce a stimulation fluid via multiple points of entry into the formation, each of the points of entry being positioned along the wellbore and adjacent to multiple zones. Individually treating each zone can be time-consuming and may necessitate additional equipment, for example, to isolate points of entry adjacent to the point of entry utilized to treat a particular zone. In addition, it may also be advantageous to introduce a stimulation fluid into a formation to re-fracture one or more previously fractured formations or zones thereof (e.g., to extend or create new fractures within the formation). Such re-fracturing treatments, for similar reasons, may also be time-consuming and may also necessitate additional equipment.

As such, there exists a need for a method and the associated equipment that will allow an operator to introduce a stimulation fluid into multiple formation zones, for example, via multiple points of entry, to create fractures in a single operation while assuring adequate distribution of treatment fluid. Particularly, there exists a need for a method and the associated equipment that will allow an operator to introduce a stimulation fluid into multiple formation zones without necessitating that each zone be individually treated.

SUMMARY

Disclosed herein is a method of servicing a subterranean formation comprising providing a wellbore penetrating the subterranean formation and having a casing string disposed therein, the casing string comprising a plurality of points of entry, wherein each of the plurality of points of entry provides a route a fluid communication from the casing string to the subterranean formation, introducing a treatment fluid into the subterranean formation via a first flowpath, and diverting the treatment fluid from the first flowpath into the formation to a second flowpath into the formation.

Also disclosed herein is a method of servicing a subterranean formation comprising providing a plurality of points of entry into the subterranean formation associated with a first stage of a wellbore servicing operation, introducing a composite treatment fluid into the subterranean formation via a first of the plurality of points of entry into the formation associated with the first stage, introducing a diverting fluid into the first of the plurality of points of entry into the formation, wherein introducing a diverting fluid into the first of the plurality of points of entry into the formation associated with the first stage causes the composite treatment fluid to be diverted from the first of the plurality of points of entry associated with the first stage to a second of the plurality of points of entry associated with the first stage, and introducing the composite treatment fluid into the subterranean formation via the second of the plurality of points of entry into the formation associated with the first stage.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
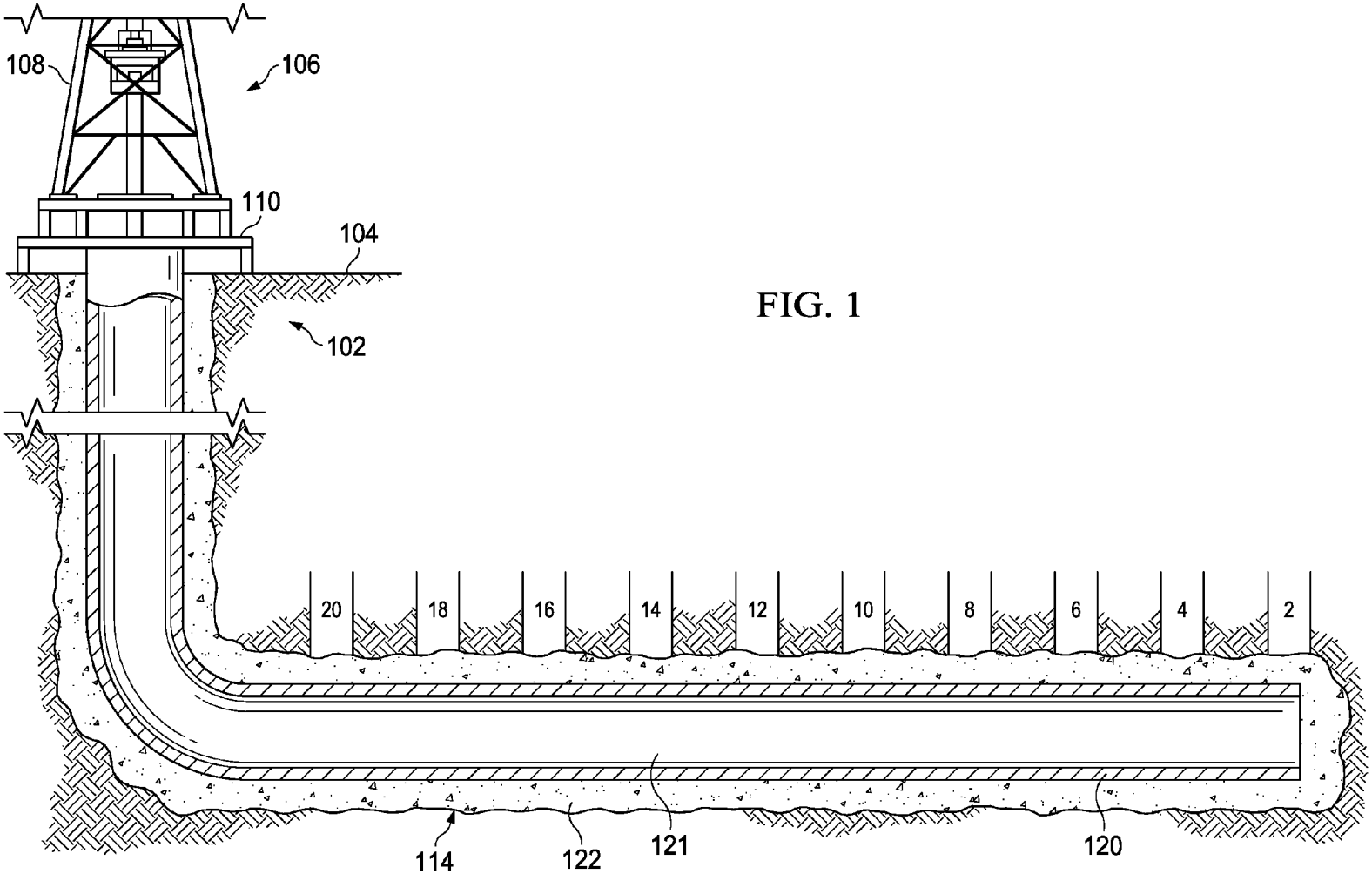
FIG. 1 is partial cut-away view of an embodiment of an environment in which a multi-interval treatment method may be employed.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing methods, as well as apparatuses and systems that may be utilized in performing the same. Particularly, disclosed herein are one or more embodiments of a multi-interval treatment (MIT) method. In an embodiment, the MIT method, as will be disclosed herein, may allow an operator to introduce a treatment (e.g., a stimulation fluid, such as a fracturing fluid) into multiple zones of a subterranean formation, for example, via multiple points of entry, in a single treatment stage, for example a continuous treatment stage (e.g., without the need to reconfigure a downhole tool between treatment of successive zones). Particularly, the MIT method or a similar treatment method may allow an operator to introduce a treatment fluid into multiple formation zones without necessitating that each zone be individually treated.

Referring to FIG. 1, an embodiment of an operating environment in which such a wellbore servicing apparatus and/or system may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to the embodiment of FIG. 1, the operating environment generally comprises a wellbore 114 that penetrates a subterranean formation 102 comprising a plurality of formation zones 2, 4, 6, 8, 10, 12, 14, 16, 18, and 20 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig comprises a derrick with a rig floor through which a work string (e.g., a drill string, a tool string, a segmented tubing string, a jointed tubing string, or any other suitable conveyance, or combinations thereof) generally defining an axial flowbore may be positioned within or partially within the wellbore 114. In an embodiment, such a work string may comprise two or more concentrically positioned strings of pipe or tubing (e.g., a first work string may be positioned within a second work string). The drilling or servicing rig may be conventional and may comprise a motor driven winch and other associated equipment for lowering the work string into the wellbore 114. Alternatively, a mobile workover rig, a wellbore servicing unit (e.g., coiled tubing units), or the like may be used to lower the work string into the wellbore 114. In such an embodiment, the work string may be utilized in drilling, stimulating, completing, or otherwise servicing the wellbore, or combinations thereof.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved and such wellbore may be cased, uncased, or combinations thereof.

Figure 2:
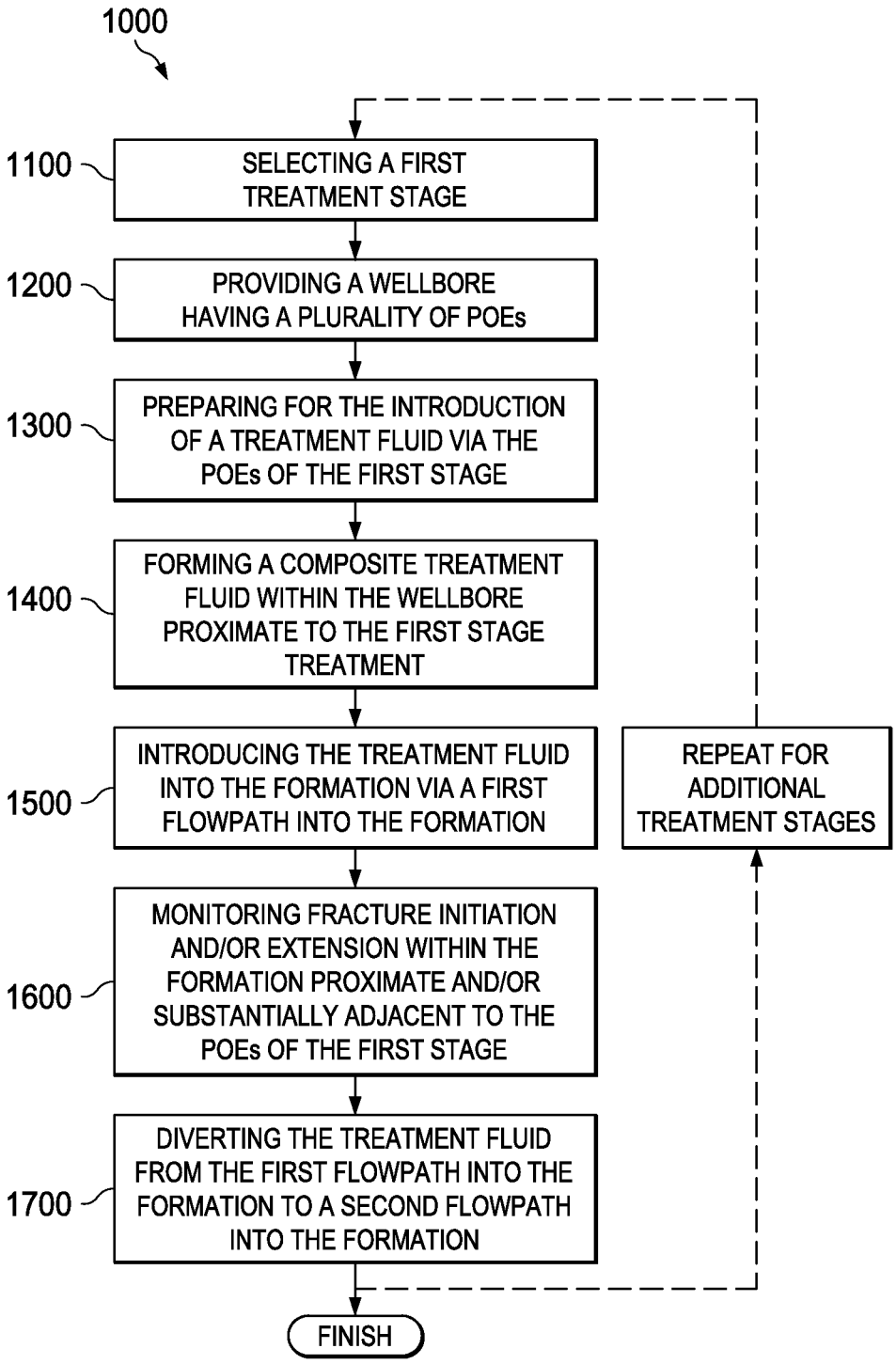
FIG. 2 is a schematic representation of a multi-interval treatment method.

Referring to FIG. 2, an embodiment of the MIT method 1000 is depicted. In the embodiment of FIG. 2, the MIT method 1000 generally comprises the steps of selecting a first treatment stage 1100; providing a wellbore having a plurality of points of entry (POEs) 1200; preparing for the introduction of a treatment fluid via the POEs of the first stage 1300; forming a composite treatment fluid within the wellbore proximate to the first treatment stage 1400; introducing the composite treatment fluid into the formation via a first flowpath of the first treatment stage into the formation 1500; monitoring fracture initiation and/or extension within the formation proximate and/or substantially adjacent to the POEs of the first treatment stage 1600; diverting the treatment fluid from the first flowpath of the first treatment stage into the formation to a second flowpath of the first treatment stage into the formation 1700.

In an embodiment, the MIT method 1000 may further comprise continuing to introduce the treatment fluid into the formation via the second flowpath of the first treatment stage into the formation; and diverting the treatment fluid from the second flowpath of the first treatment stage into the formation to a third flowpath of the first treatment stage into the formation.

In an additional embodiment, one or more of the steps of selecting a second stage, preparing for the introduction of the treatment fluid via the POEs of the second treatment stage, forming the composite treatment fluid within the wellbore proximate to the second treatment stage, introducing the composite treatment fluid in the formation via a first flowpath of the second stage into the formation, monitoring fracture initiation and/or extension within the formation proximate and/or substantially adjacent to the second treatment stage, and diverting the treatment fluid from the first flowpath of the second stage into the formation to a second flowpath of the second stage into the formation may performed with respect to the second treatment stage, for example, as disclosed herein with respect to the first treatment stage.

In various embodiments and as will be disclosed herein, the MIT method 1000 may be applicable to newly completed wellbores, previously completed wellbores that have not been previously stimulated or subjected to production, previously completed wellbores that have not been previously stimulated but have been previously subjected to production, wellbores that have been previously stimulated but have been previously subjected to production, or combinations thereof.

In an embodiment, the formation 102 may be treated in one or more treatment stages. As used herein, the term "treatment stage" generally refers to two or more POEs that are subjected to a treatment fluid (e.g., fracturing fluid) substantially contemporaneously, as will be disclosed herein. As used herein, the term "point of entry" or "POE" generally refers to a locus within a wellbore that allows access, in the form of fluid communication, to and/or from the formation proximate and/or substantially adjacent thereto. In an embodiment, a first, second, third, fourth, fifth, etc., treatment stage may be selected so as to comprise multiple POEs (e.g., step 1100 in the embodiment of the MIT method 1000 of FIG. 2). In an embodiment, each treatment stage may comprise two, three, four, five, six, seven, eight, nine, ten, 15, 20, or more POEs. Additionally, in an embodiment, the POEs of a given stage may allow access, in the form of fluid communication, to one, two, three, four, five, six, seven, eight, nine, ten, or more formation zones. The POEs of a given treatment stage may generally be adjacent to one or more other POEs of the same treatment stage.

In an embodiment, a wellbore, for example, wellbore 114 illustrated in FIG. 1, the wellbore 114 having a plurality of POEs by which to access the formation or formations penetrated by the wellbore, for example, formation 102 illustrated in FIG. 1 (e.g., step 1200 in the embodiment of the MIT method 1000 of FIG. 2) may be provided. In an embodiment, the POEs of a given (e.g., a first) stage may be provided (for example, as will be disclosed herein) and the formation and/or zones thereof associated with such stage may be treated (for example, as will also be disclosed herein) prior to provision of the POEs of another, later (e.g., a second, third, fourth, etc.) stage. Alternatively, in embodiments where one or more POEs are already present within the wellbore, the formation and/or zones thereof may be serviced as a single treatment stage (e.g., such that all POEs already present are included within that treatment stage).

Referring again to FIG. 1, in an embodiment, the wellbore 114 may be at least partially cased with a casing string 120 generally defining an axial flowbore 121. In an embodiment, some portion of the casing string 120 may comprise a liner. Additionally or alternatively, the wellbore may comprise two or more casing strings, at least a portion of a first casing string being concentrically positioned within at least a portion of a second casing string. In an alternative embodiment, at least a portion of a wellbore like wellbore 114 may remain uncased. The casing string 120 may be secured into position within the wellbore 114 in a conventional manner with cement 122, alternatively, the casing string 120 may be partially cemented within the wellbore, or alternatively, the casing string may be uncemented. For example, in an alternative embodiment, a portion of the wellbore 114 may remain uncemented, but may employ one or more packers (e.g., mechanical packers or swellable packers, such as Swellpackers™, commercially available from Halliburton Energy Services, Inc.) to isolate two or more adjacent portions, zones, or stages within the wellbore 114. In an embodiment, where the casing string comprises a liner, the liner may be positioned within a portion of the wellbore 114, for example, lowered into the wellbore 114 suspended from the work string. In such an embodiment, the casing string (e.g., the liner) may be suspended from the work string by a liner hanger or the like. Such a liner hanger may comprise any suitable type or configuration of liner hanger, as will be appreciated by one of skill in the art with the aid of this disclosure.

In an embodiment, as may be appreciated by one of skill in the art upon viewing this disclosure, a casing string or liner, such as casing string 120, may generally comprise a pipe or tubular, which may comprise a plurality of joints or sections, and which may be placed within the wellbore for the purpose of maintaining formation integrity, preventing collapse of the wellbore, controlling formation fluids, preventing unwanted losses of fluid to the formation, or the like. As such, the casing string 120 may be configured to prevent unintended fluid communication between the axial flowbore 121 and the formation 102. As such, in an embodiment, a POE may comprise a route of fluid communication through the casing string 120. Additionally, where the casing string is surrounded by and/or secured with cement (e.g., a sheath of cement 122 surrounding the casing string 120, as illustrated in FIG. 1), the POE may further comprise a route of fluid communication through the cement. In various embodiments as will be disclosed herein, such a POE may take one or more of various forms, as may be suitable.

Figure 3A:
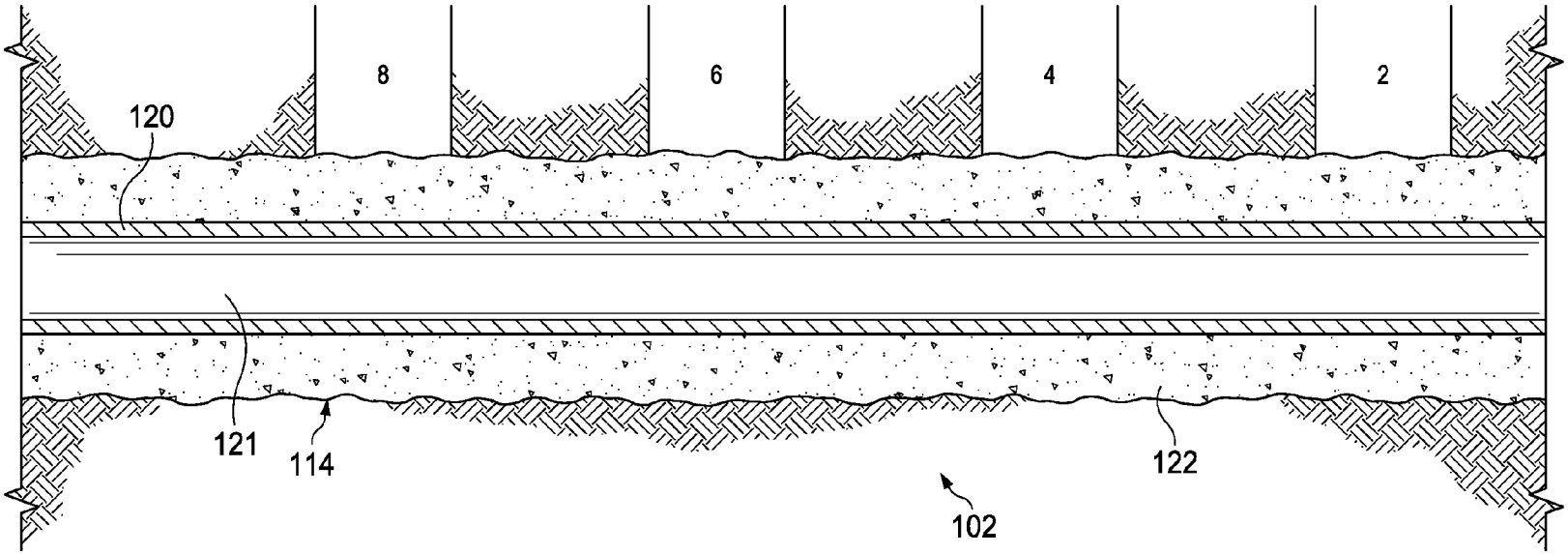
FIG. 3A is a cut-away view of an embodiment of a wellbore penetrating a subterranean formation, the wellbore having a casing string having no points of entry to the subterranean formation.

In an embodiment, POEs may be previously absent from the casing string 120. In such an embodiment, a suitable number and configuration of POEs may be introduced into or otherwise provided within the casing string 120, for example, to allow access to the formation 102 and/or a zone therefore (e.g., formation zone 2, 4, 6, 8, 10, 12, 14, 16, 18, and/or 20). For example, as noted above, in an embodiment the MIT method may be applicable to newly completed wellbores (i.e., new completions) and/or to wellbores or zones that were previously completed but have never been subjected to production (e.g., fluids have never been produced from the formation via the wellbore or zones) and/or have never been stimulated (e.g., via a formation treatment operation such as a fracturing and/or perforating operation). In such an embodiment, POEs may be absent from the casing string 120. Referring to FIG. 3A, an embodiment of a wellbore 114 having a casing string 120 with no POEs (e.g., from which POEs are absent) is illustrated, for example, a new completion. In the embodiment of FIG. 3A, where the casing string 120 does not comprise any POEs, the POEs may be introduced into or otherwise provided within the casing string 120.

In an embodiment, a POE may comprise one or more perforations and/or perforation clusters (e.g., a plurality of associated or closely-positioned perforations). As may be appreciated by one of skill in the art upon viewing this disclosure, perforations generally refer to openings extending through the walls of a casing and/or liner, through the cement sheath surrounding the casing or liner (when present), and, in some embodiments, into the formation.

In an embodiment, forming perforations may occur by any suitable method or apparatus. For example, in an embodiment, the perforations may be formed by a fluid jetting apparatus (e.g., a hydrajetting tool). A suitable fluid jetting apparatus and the operation thereof is disclosed in each of U.S. Publication No. 2011/0088915 to Stanojcic et al., U.S. Publication No. 2010/0044041 to Smith et al., and U.S. Pat. No. 7,874,365 to East et al., each of which is incorporated herein in its entirety.

Figure 3B:
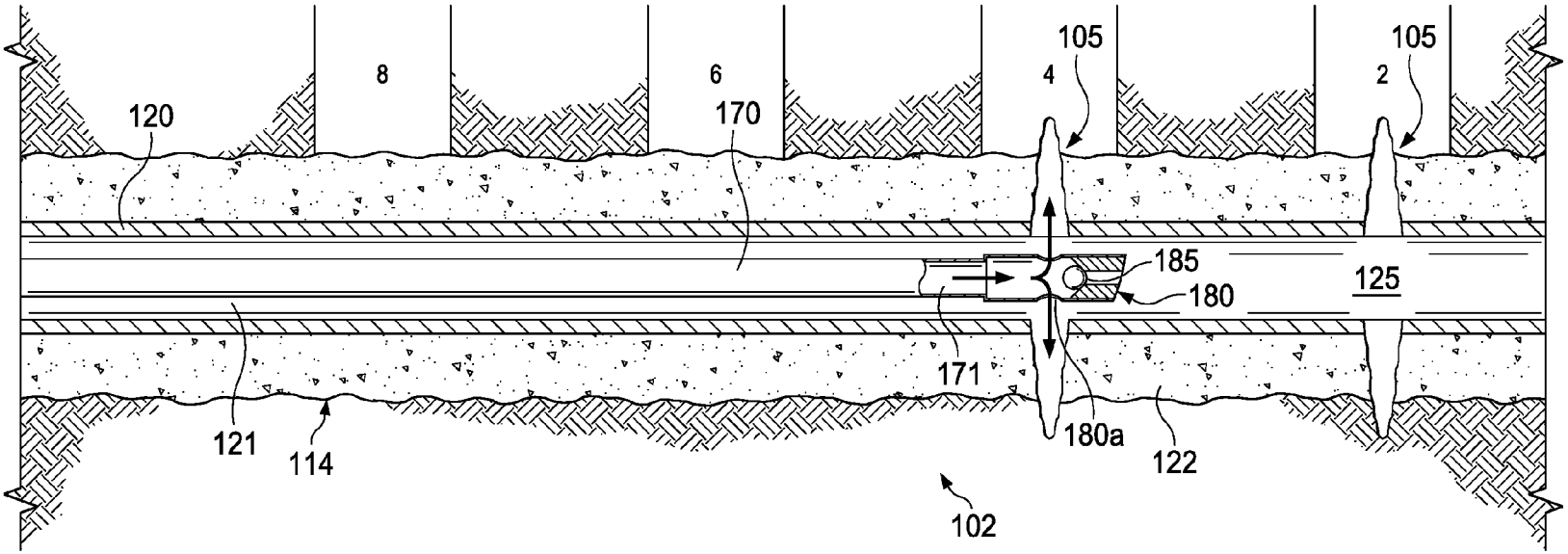
FIG. 3B is a cut-away view of an embodiment of the provision of one or more points entry within the casing string of FIG. 3A.

Referring to FIG. 3B, an embodiment of a fluid jetting apparatus 180 is illustrated in operation within the wellbore 114. In the embodiment of FIG. 3B, the fluid jetting apparatus is suspended within the axial flowbore 121 of the casing string 120 from a suitable workstring 170, the work string 170 generally defining an axial flowbore 171. In such an embodiment, the workstring 170 may comprise a coiled tubing string, a drill string, a tool string, a segmented tubing string, a jointed tubing string, or any other suitable conveyance, or combinations thereof. In an embodiment, the fluid jetting apparatus 180 is selectively configurable to deliver a relatively low-volume, relatively high-pressure fluid stream (e.g., as would be suitable for a perforating operation) or to deliver a relatively high-volume, relatively low-pressure fluid stream (e.g., as would be suitable for a fracturing operation). In the embodiment of FIG. 3B, the fluid jetting apparatus 180 is configured for a perforating operation, for example, by introducing an obturating member 185 (e.g., via a ball or dart) into the work string and forward-circulating the obturating member 185 to engage a seat or baffle within the fluid jetting apparatus 180 and thereby configure the fluid jetting apparatus 180 for the perforating operation (e.g., by providing a route of fluid communication via one or more fluid jetting orifices and by obscuring a route of fluid communication via one or more relatively high-volume fracturing ports). The fluid jetting apparatus 180 may be positioned proximate and/or substantially adjacent to the formation zone into which a perforation (e.g., a POE) is to be introduced (e.g., formation zone 4, as illustrated in the embodiment of FIG. 3B) and a suitable perforating fluid may be pumped via the flowbore 171 of the work string 170 to the fluid jetting apparatus 180. In various embodiments, the fluid may comprise a particulate and/or abrasive material (e.g., proppant, sand, steel fines, glass particles, and the like). The fluid may be pumped at rate and/or pressure such that the fluid is emitted from the fluid jetting apparatus 180 via the fluid jetting orifices (e.g., jets, nozzles, erodible nozzles, or the like) at a rate and/or pressure sufficient to erode, abrade, and/or degrade walls of the adjacent and/or proximate casing string 120, and/or the cement sheath 122 surrounding the casing string 120, and thereby forming one or more POEs 105 (e.g., perforations). Additionally, the fluid may erode into the formation 102 or a zone thereof (e.g., formation zones 2 and 4, as illustrated in the embodiment of FIG. 3B), for example, so as to initiate a fracture within the formation 102. The perforating fluid may be returned to the surface via a flowpath comprising an annular space 125 between the workstring 170 and the casing string 120.

In an alternative embodiment, the perforations may be formed by the operation of a perforating gun. Such a perforating gun may be configured to selectively detonate one or more explosive charges and thereby penetrating the walls of the casing or liner and/or cement and so as to create the perforation. A suitable perforating gun may be conveyed into position within the wellbore via a workstring (e.g., a coiled tubing string), a wireline, a tractor, by any other suitable means of conveyance, as will be appreciated by one of skill in the art viewing this disclosure. In such an embodiment, the perforating gun may be lowered into the wellbore, for example, suspended from a workstring like workstring 170 or a wireline, and actuated (e.g., fired) to form perforations.

In still another embodiment, a casing string or liner may be perforated prior to placement within a wellbore.

Figure 4A:
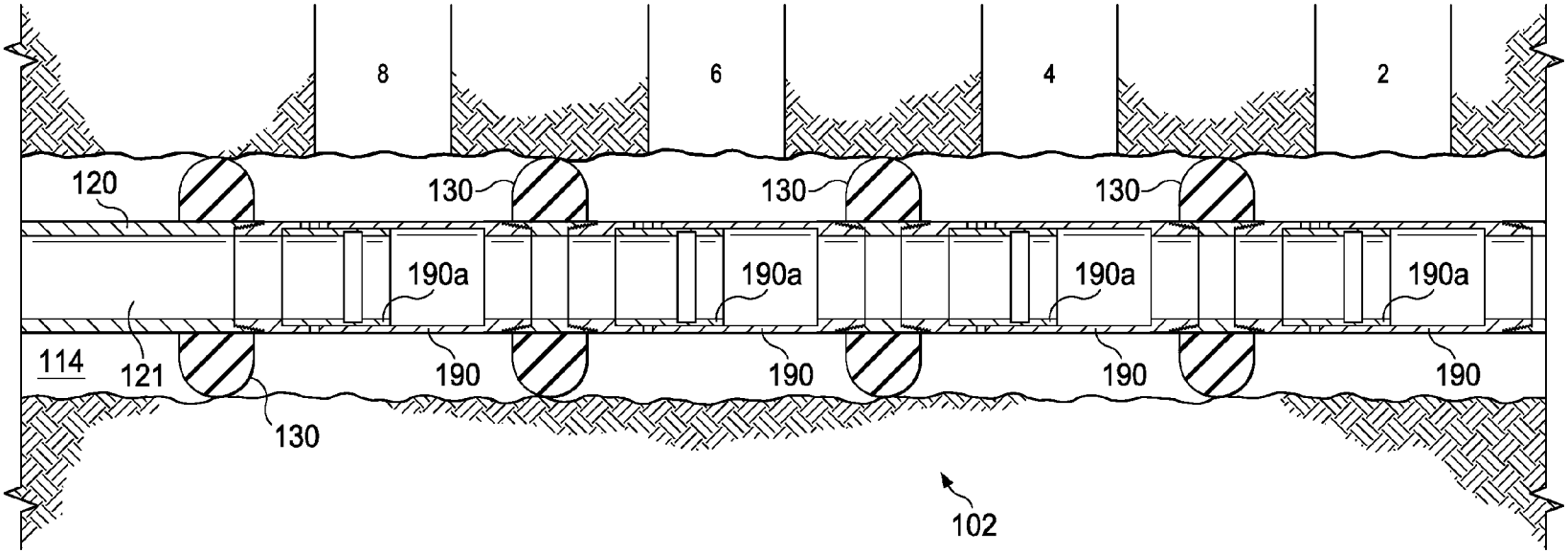
FIG. 4A is a cut-away view of an embodiment of a wellbore penetrating a subterranean formation, the wellbore having a casing string having a plurality of casing windows which may be configured to provide a point of entry to the subterranean formation.

In an alternative embodiment, a POE may comprise a casing window and/or casing door assembly. Referring to FIG. 4A, an embodiment in which the casing string 120 comprises multiple casing window assemblies 190, incorporated therein, is illustrated. In the embodiment of FIG. 4A in which the casing string is not cemented within the wellbore 114, the casing string 120 also comprises a plurality of packers 130 (e.g., mechanical packers or swellable packers, such as SwellPackers™, commercially available from Halliburton Energy Services), utilized to secure the casing string 120 within the wellbore 114 and to isolate adjacent intervals of the wellbore 114 and/or adjacent formation zones (e.g., 2, 4, 6, and/or 8). As may be appreciated by one of skill in the art upon viewing this disclosure, the casing window assembly may generally refer to an assemblage, which may be incorporated within a casing string or liner, and which may be configurable to provide a route of fluid communication between the axial flowbore of the casing and an exterior of the casing. In an embodiment, the casing windows may be activatable and/or deactivatable, for example, such that the casing windows are selectively configurable to allow and/or disallow fluid communication. For example, a casing window assembly may generally comprise a housing having one or more ports providing a route of fluid communication between the axial flowbore of the casing and an exterior of the casing dependent upon the positioning of a sliding sleeve. The sliding sleeve may be movable, relative to the housing, from a first position (e.g., a closed position), in which the sliding sleeve obstructs the ports, to a second position (e.g., as open position), in which the sliding sleeve does not obstruct the ports. Additionally, in an embodiment, the ports may be fitted with a suitable fluid-pressure altering device (e.g., jets, nozzles, erodible nozzles, or the like), for example, such that fluid communication via the fluid-pressure altering device may erode and/or degrade a portion of the formation and/or, when present, a cement sheath surrounding the casing window assembly (e.g., in embodiments where a cement sheath is present).

In various embodiments, the casing windows may be activatable and/or deactivatable by any suitable method or apparatus. For example, in various embodiments, a casing window assembly may be activatable or deactivatable, (e.g., by transitioning the sliding sleeve from the first to the second position or from the second to the first position) via one or more of a mechanical shifting tool, an obturating member (e.g., a ball or dart), a wireline tool, a pressure differential, a rupture disc, a biasing member (e.g., a spring), or combinations thereof. Suitable casing window assemblies and methods of operating the same are disclosed in each of U.S. Publication No. 2011/0088915 to Stanojcic et al. and U.S. Publication No. 2010/0044041 to Smith et al., each of which is incorporated herein in its entirety.

Figure 4B:
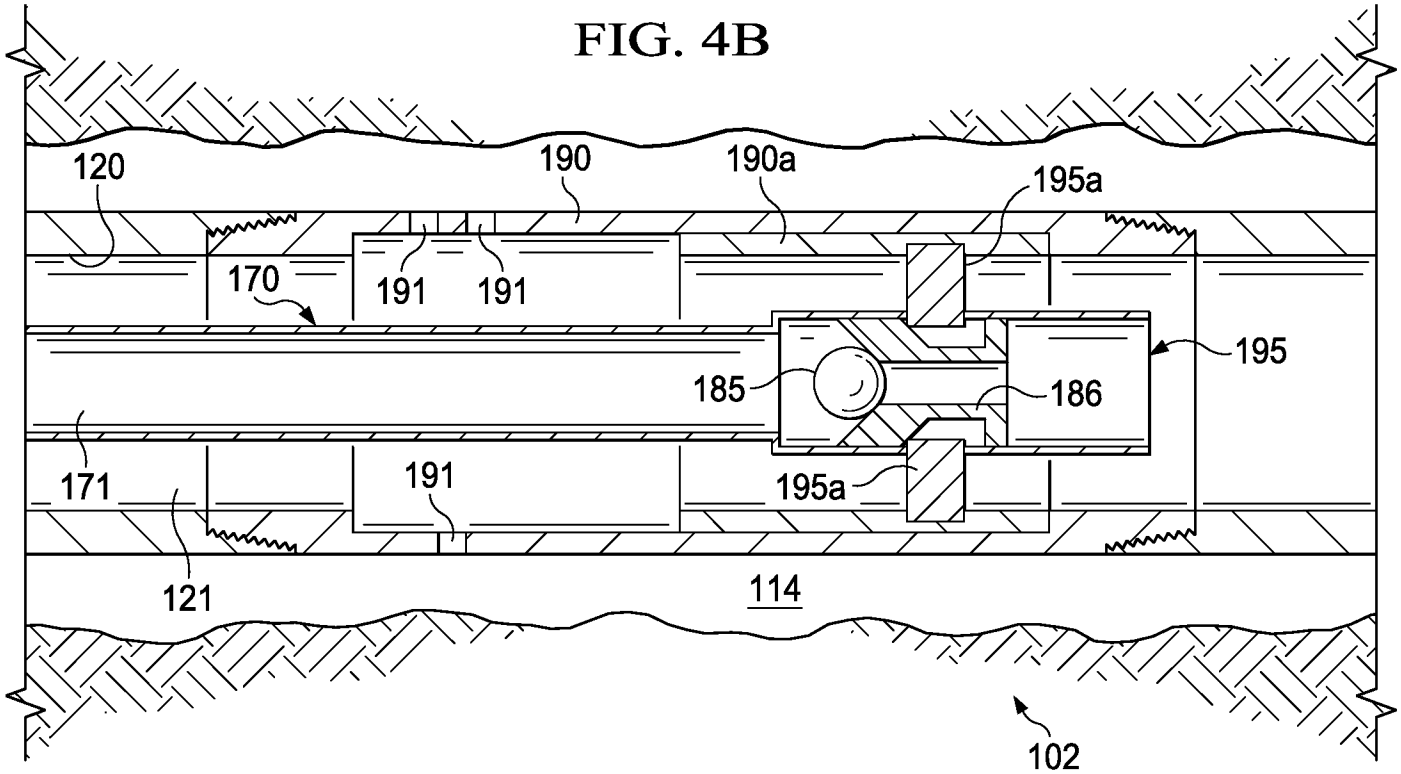
FIG. 4B is a cut-away view of an embodiment of the provision of one or more points of entry within the casing string of FIG. 4A.

In the embodiment of FIG. 4A, each of the casing window assemblies 190 is illustrated in a deactivated configuration, for example, in a configuration in which fluid communication between the axial flowbore 121 of the casing 120 is disallowed. Referring to FIG. 4B, an embodiment of a means by which each of the casing window assemblies 190 may be transitioned from the deactivated configuration to the activated configuration, in which fluid communication between the axial flowbore 121 of the casing string 120 and the formation is allowed is illustrated (e.g., an actuating assembly or means for actuating a casing window). In the embodiment of FIG. 4B, the casing window assembly 190 is shown being activated (e.g., transitioned) by a mechanical shifting tool 195. Suitable mechanical shifting tools and methods of operating the same are disclosed in each of U.S. Publication No. 2011/0088915 to Stanojcic et al. and U.S. Publication No. 2010/0044041 to Smith et al., each of which is incorporated herein in its entirety. In the embodiment of FIG. 4B, the mechanical shifting 195 tool is suspended within the axial flowbore 121 of the casing string 120 from a suitable workstring 170 generally defining an axial flowbore 171. In such an embodiment, the workstring 170 may comprise a coiled tubing string, a drill string, a tool string, a segmented tubing string, a jointed tubing string, or any other suitable conveyance, or combinations thereof. In the embodiment of FIG. 4B, the mechanical shifting tool 195 may be positioned within the wellbore 114 substantially adjacent to a casing window assembly to be activated and/or deactivated. The mechanical shifting tool 195 may then be actuated, for example, by introducing an obturating member 185 (e.g., a ball or dart) into the workstring 170 and forward-circulating the obturating member 185 to engage a seat or baffle 186 within the mechanical shifting tool 195. Upon engaging the seat 186, the obturating member may obstruct the flowbore through the mechanical shifting tool 195, thereby causing pressure to be applied to the seat to extend one or more extendible members 195*a*. Extension of the extendible members 195*a* may cause the extendible members to engage a corresponding or mating structure such as one or more dogs, keys, catches, profiles, grooves, or the like within the sliding sleeve of the proximate casing window assembly 190, and thereby engage the sliding sleeve 190*a*. With the mechanical shifting tool 195 engaged to the sliding sleeve 190*a* of the casing window assembly 190, movement of the work string 170 (and, thus, the mechanical shifting tool 195) with respect to the casing window assembly 190 may shift the sliding sleeve 190*a*, thereby obscuring or unobscuring ports 191 of the casing window assembly (e.g., windows or doors) 190, thereby either allowing or disallowing fluid communication. In such an embodiment, movement of the sliding sleeve 190*a* of a particular casing window assembly may provide a POE.

In alternative embodiments, a casing window assembly 190 may be activated and/or deactivated by any suitable method or apparatus. Suitable methods and apparatuses may be appreciated by one of skill in the art upon viewing this disclosure.

In an alternative embodiment, one or more POEs may already be present within a wellbore. For example, as noted above, in an alternative embodiment, the MIT method may be applicable to wellbores that have previously been stimulated and/or subjected to production. For example, such POEs may be present as the result of a prior stimulation treatment (e.g., a fracturing, perforating, acidizing, or like operation) or as the result of prior production (e.g., hydrocarbon production) from the formation via the wellbore. In such an embodiment, one or more POEs may be present within the casing 120.

In an embodiment, the POEs may comprise perforations, casing windows, or combinations thereof, for example, as disclosed herein. In various embodiments, such POEs may be present from a prior stimulation operation, prior production from the wellbore, prior injection operations, or combinations thereof.

In an additional embodiment, it may be desirable to introduce one or more additional POEs into a casing string or liner which already comprises one or more POEs. For example, in an embodiment an operator may desire to introduce additional POEs so as to treat or otherwise stimulate a previously stimulated and/or unproduced formation zone. In such an embodiment, any such additional POEs may be introduced as disclosed herein or by any other suitable method.

In an embodiment, the wellbore, one or more of the POEs within the wellbore (e.g., the POES of a given treatment stage), or both may be prepared for the introduction of the treatment fluid (e.g., step 1300 in the embodiment of the MIT method 1000 of FIG. 2).

In an embodiment, the wellbore and/or POEs within the wellbore may be prepared by removing and/or otherwise disposing of one or more downhole tools and/or equipment, for example, as may be present within the wellbore, or some portion thereof. As may be appreciated by one of skill in the art upon viewing this disclosure, such downhole equipment may include, but is not limited to production tubing and associated equipment, baffles (e.g., as may be attached to a casing window assembly), plugs (e.g., bridge plugs, fracturing plugs, or the like). In such an embodiment, where it is desired that any of such downhole tools (or a portion thereof) be removed and/or disposed of, the removal or disposal may occur by any suitable method or apparatus (e.g., physical removal, fishing out, drilling out, running out, dissolution, combustion, disintegration, etc.).

In an embodiment, removing a tool (or a portion thereof) may comprise drilling out the flowbore of the casing string. In such an embodiment, a drilling assembly, for example, comprising a bit and/or motor, may be run into the wellbore, for example, on a work string, a drill string, or the like, and operated, for example, by circulating a drilling fluid through the drilling assembly, to drill out (e.g., cut or abrade away) any equipment, or a significant portion thereof, as may be desirably removed.

In an alternative embodiment, removing the tools (or a portion thereof) may comprise degrading and/or consuming the tool. For example, in an embodiment, a downhole tool (e.g., a fracturing plug or bridge plug) may comprise a degradable or consumable material. In such an embodiment, degrading or consuming the tool, or a portion thereof, may comprise igniting the tool (e.g., exposing the tool to a source of heat and oxygen), exposing the tool to a corrosive or degrading fluid (e.g., an acid), or the like. In such an embodiment, upon degradation or consumption of the degradable or consumable material, the tool may be completely or substantially destroyed, alternatively, the tool may be configured to release an inner bore surface (e.g., the axial flowbore 121 of the casing string 120) and thereby fall away.

In an additional embodiment, the wellbore and/or POEs within the wellbore may be prepared by a clean-out operation. In such an embodiment, the wellbore may be cleaned out by any suitable method or apparatus. For example, in an embodiment a wellbore may be cleaned out by circulating a suitable clean-out fluid through the wellbore to remove debris, for example, as may have been generated during production and/or an operation to introduce the POEs and/or to remove various downhole tools. Examples of a suitable clean-out fluids include, but are not limited to, aqueous fluids, oil-based fluids, acids, nitrogen-containing fluids, or combinations thereof.

In an additional embodiment, the wellbore and/or POEs within the wellbore may be prepared by isolating the POEs of the first treatment stage from any POEs located further downhole. In such an embodiment, the POEs of the first treatment stage may be isolated from one or more relatively more downhole POEs by any suitable apparatus or method.

Figure 5:
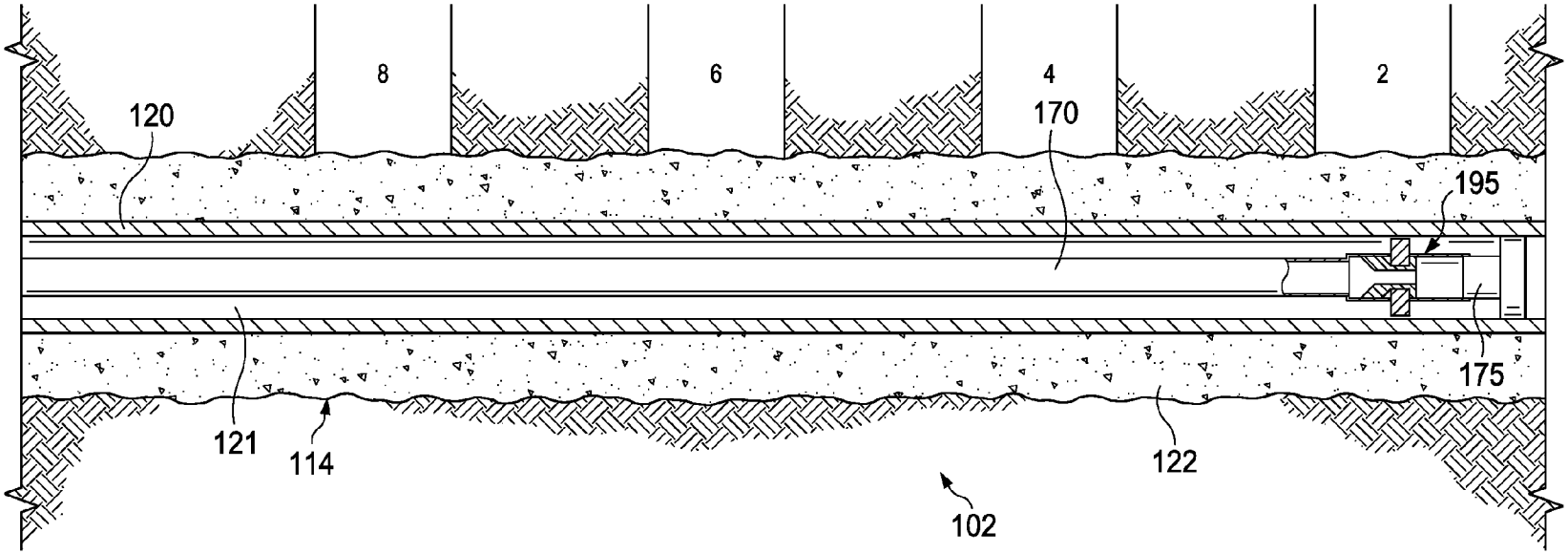
FIG. 5 is a cut-away view of an embodiment of a wellbore penetrating a subterranean formation, the wellbore having a casing string having a plurality of points of entry to the formation.

In an embodiment, the POEs may be isolated from relatively more downhole POEs by a bridge plug, a fracturing plug, or the like. In such an embodiment, the bridge or fracturing plug may be positioned within the wellbore (e.g., within the flowbore 121 of the casing string 120) and set. For example, the bridge or fracturing plug may be positioned within the wellbore via a work string, a wireline, or any suitable conveyance. The bridge or fracturing plug may be set (e.g., actuated), for example, mechanically, hydraulically, or by the expansion of a swellable member. An example of a suitable plug is disclosed in U.S. Pat. No. 8,056,638, which is incorporated herein in its entirety. For example, referring to FIG. 5, a plug 175 is illustrated being positioned within the wellbore suspended from the work string 170. In the embodiment of FIG. 5, the plug 175 is releasably secured to the work string and/or to a downhole end or portion of a tool attached to the work string 170 (e.g., a fluid jetting apparatus or a mechanical shifting tool, as disclosed herein). When the plug 175 has been positioned at a desired location within the wellbore, the plug 175 may be set (e.g., actuated so as to engage the inner walls of the casing string 120) and released from the work string or a tool attached thereto. In various embodiments, the plug may be removable and/or retrievable, for example, upon unsetting, degradation, consumption, drilling, or by any suitable method or apparatus.

In an alternative embodiment, the POEs may be isolated from one or more relatively more downhole POEs by a particulate plug, such as a sand plug, a proppant plug, a composite material plug, a degradable material plug (e.g., as will be disclosed herein) or the like. In such an embodiment, such a plug may be introduced into the wellbore (e.g., within the flowbore 121 of the casing string 120) as a particulate-laden fluid or a gel-forming fluid. The particulate-laden fluid or gel-forming fluid may be delivered into and deposited within the wellbore (e.g., within the flowbore 121 of the casing string 120) and thereby form the plug, for example, so as to inhibit or lessen fluid flow into or through that portion of the wellbore. In an additional embodiment, such a sand or proppant plug may be removable, for example, by reverse circulation (e.g., a wash-out), acid treatment, degradation, or combinations thereof.

In an embodiment, for example, in the embodiment of FIG. 5, isolation (e.g., via a plug or the like) may be provided prior to provision of one or more POEs of a given treatment stage. In an alternative embodiment, isolation may be provided where one or more POEs of a given treatment stage are already present within a wellbore.

Figure 6A:
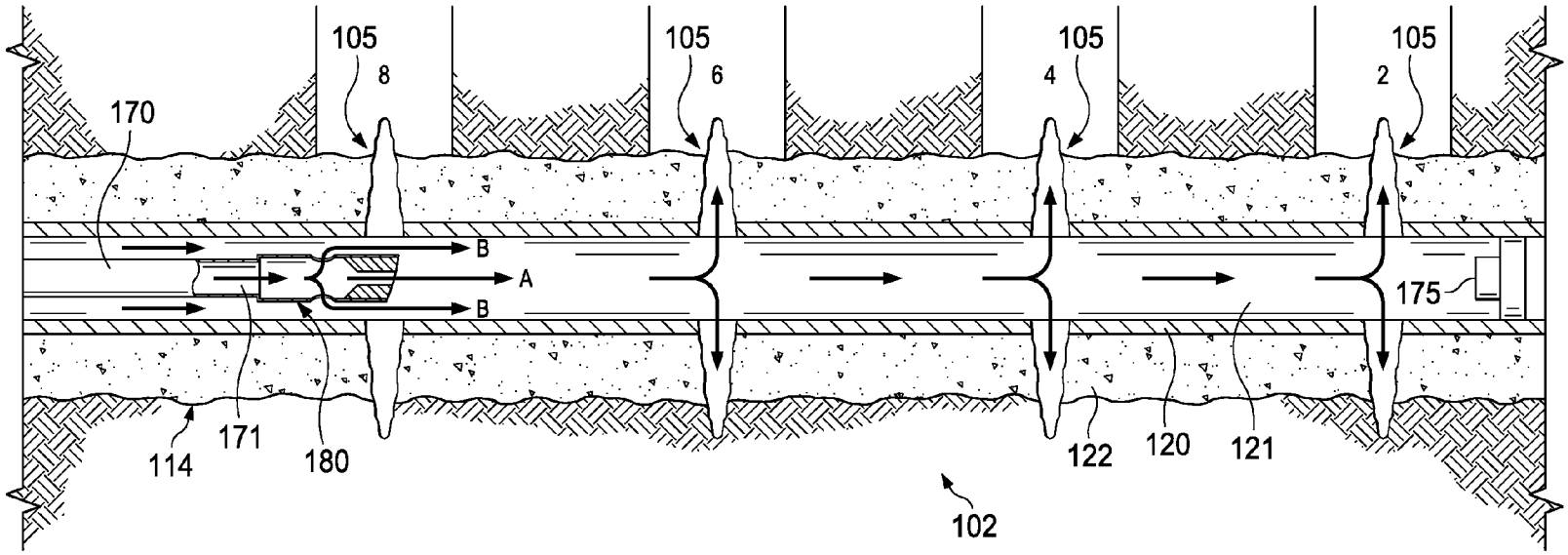
FIG. 6A is a cut-away view of an embodiment of the separate provision of multiple components of a composite treatment fluid within a downhole portion of a wellbore.

In an additional embodiment, the wellbore and/or POEs within the wellbore may be prepared by providing two separate flowpaths into the wellbore. In an embodiment, the two separate flowpaths may be provided to a depth and/or position within the wellbore that is proximate to or slightly more shallow than the relatively most shallow (e.g., relatively most uphole) POE. Referring to the embodiment of FIG. 6A, the first treatment stage comprises the POEs 105 (e.g., via perforations) adjacent to formation zones 2, 4, 6, and 8. In the embodiment of FIG. 6A, the work string 170 is positioned such that, as noted above, it is adjacent to but slightly above (e.g., more shallow than) the relatively most shallow, relatively most uphole POE 105, particularly, the POE adjacent to formation zone 8.

In an embodiment, each of the two separate flowpaths into the wellbore may comprise any suitable flowpath. Examples of multiple flowpaths into a wellbore and methods of utilizing multiple flowpaths are disclosed in U.S. Publication No. 2010/0044041 to Smith et al., which is incorporated herein in its entirety. For example, referring again to FIG. 6A, an embodiment in which two separate flowpaths are provided into the wellbore 114 is illustrated. In the embodiment of FIG. 6A, one or more of the plurality of POEs 105 have been introduced, for example, via the fluid jetting apparatus 180 as disclosed herein. In such an embodiment, the work string 170 and the fluid jetting apparatus 180 may be utilized to provide the two separate flowpaths. In the embodiment of FIG. 6A, the fluid jetting apparatus 180 may be reconfigured from a jetting perforating configuration, for example, to a fracturing configuration configured to deliver a relatively high-volume, relatively low-pressure fluid stream (e.g., configured to deliver a fracturing fluid). In the embodiment of FIG. 6A, the fluid jetting apparatus 180 may be configured to deliver a fracturing fluid by removing the obturating member, for example, by reverse-circulating a fluid such that the obturating member disengages the seat or baffle within the fluid jetting apparatus 180 and is returned toward the surface and removed from the work string 170. With the obturating member removed from the fluid jetting apparatus 180, the fluid jetting apparatus 180 may be configured to deliver a relatively high-volume, relatively low-pressure fluid stream, for example, via one or more fracturing ports 180*a*.

In the embodiment of FIG. 6A, a first of the two flowpaths may comprise the flowbore 171 of the work string 170, a flowbore defined by the fluid jetting apparatus 180, and the one or more fracturing ports of the fluid jetting apparatus 180. For example, a fluid flowing via such a first flowpath may be pumped through the flowbore 171 of the work string 170, through the fluid jetting apparatus 180, and out of the fluid jetting apparatus 180 into the wellbore 114 via one or more fracturing ports, as demonstrated by flow arrows A of FIG. 6A. Also, in the embodiment of FIG. 6A, a second of the two flow patterns may comprise an annular space generally defined by the casing string 120 and the workstring 170 and fluid jetting apparatus 180. For example, a fluid flowing via such a second flowpath may be pumped through the annular space between the casing string 120 and the workstring 170 and fluid jetting apparatus 180, as demonstrated by flow arrows B of FIG. 6A.

Figure 6B:
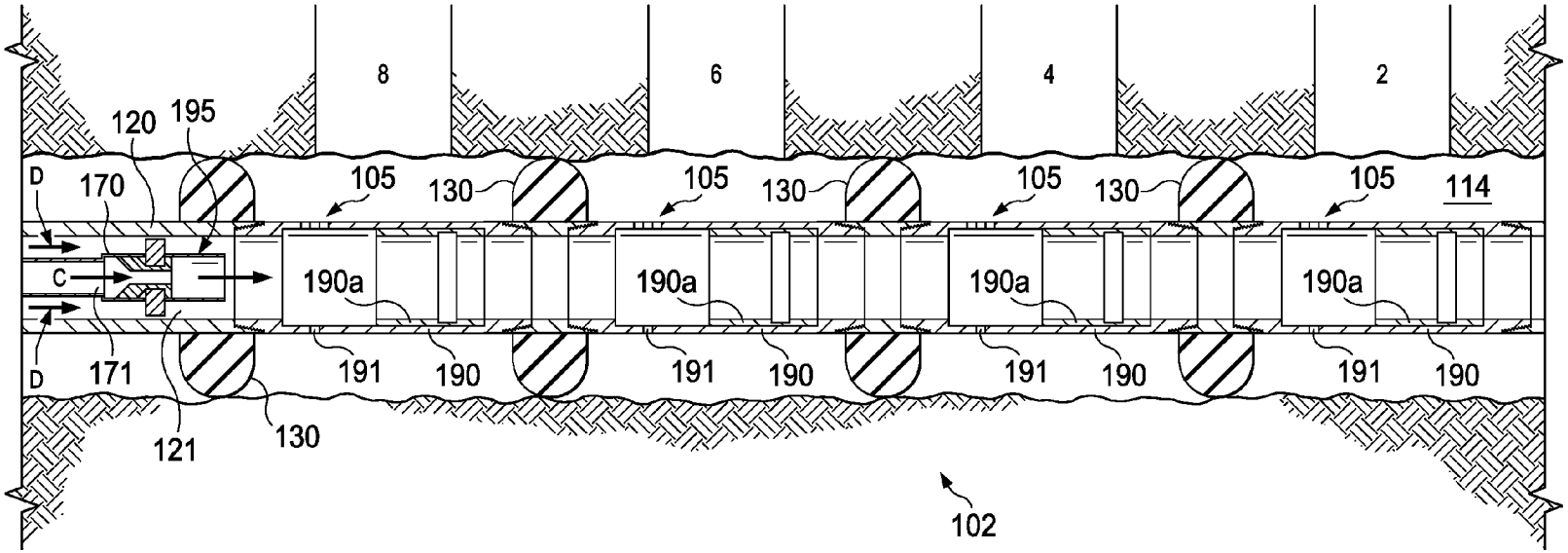
FIG. 6B is a cut-away view of an alternative embodiment of the separate provision of multiple components of a composite treatment fluid within a downhole portion of a wellbore.

Referring to the alternative embodiment of FIG. 6B, an alternative embodiment in which two separate flowpaths are provided into the wellbore 114 is illustrated. In the embodiment of FIG. 6B, the first treatment stage comprises the POEs 105 (e.g., via the open casing window assemblies 190+) adjacent to formation zones 2, 4, 6, and 8. In the embodiment of FIG. 6A, the work string 170 is positioned such that, as noted above, it is adjacent to but slightly above (e.g., more shallow than) the relatively most shallow, relatively most uphole POE of the first treatment stage, particularly, the POE 105 adjacent to formation zone 8.

In the alternative embodiment of FIG. 6B, one or more of the plurality of POEs 105 have been provided via the mechanical shifting tool 190 as disclosed herein, for example, the mechanical shifting tool 195 may be employed to selectively provide a flowpath through one or more ports of jets disposed within the casing window assemblies 190 (e.g., to open a casing window assembly, as disclosed herein). In the embodiment of FIG. 6B, the work string 170 and the mechanical shifting tool 195 may be utilized to provide the two separate flowpaths. In the embodiment of FIG. 6B, the mechanical shifting tool 195 may be reconfigured, for example, to deliver a fluid stream into the wellbore 114, for example, into the flowbore 121 of the casing string 120 (e.g., configured to deliver a fracturing fluid). In the embodiment of FIG. 6B, the mechanical shifting tool 195 may be configured to deliver a fracturing fluid by removing the obturating member, for example, by reverse-circulating a fluid such that the obturating member disengages the seat or baffle within the mechanical shifting tool 195 and is returned toward the surface and removed from the work string 170. With the obturating member removed from the mechanical shifting tool 195, the mechanical shifting tool 195 may be configured to provide a fluid stream into the wellbore, for example, a fracturing fluid.

In the embodiment of FIG. 6B, a first of the two flowpaths may comprise the flowbore 171 of the work string 170, a flowbore defined by the mechanical shifting tool 195, and one or more fracturing ports 191 of the mechanical shifting tool 195. For example, a fluid flowing via such a first flowpath may be pumped through the flowbore 171 of the work string 170, through the mechanical shifting tool 195, and out of the mechanical shifting tool 195 into the wellbore 114 via one or more fracturing ports 191, as demonstrated by flow arrows C of FIG. 6B. Also, in the embodiment of FIG. 6B, a second of the two flow patterns may comprise an annular space generally defined by the casing string 120 and the workstring 170 and mechanical shifting tool 195. For example, a fluid flowing via such a second flowpath may be pumped through the annular space between the casing string 120 and the workstring 170 and mechanical shifting tool 195, as demonstrated by flow arrows D of FIG. 6B.

Alternatively, in an embodiment in which the plurality of POEs where already present within the wellbore, for example, a re-fracturing treatment or a fracturing treatment following production from the wellbore, the first flowpath may comprise the flowbore of a work string like work string 170 and the second flowpath may comprise the annular space defined by the casing string and the work string. In such an embodiment, it may not be necessary to provide any one or more additional POEs and/or to reconfigure any one or more POEs. As such, a work string may or may not have already been present within the wellbore, as disclosed herein.

As used herein, a first flowpath may refer to any one or more of the disclosed first flowpaths, unless otherwise noted, and a second flowpath may refer to any one or more of the disclosed second flowpaths, unless otherwise noted.

In an embodiment, a composite fluid may be formed within the wellbore, for example, within a portion of the wellbore proximate to the first treatment stage (e.g., step 1400 in the embodiment of the MIT method 1000 of FIG. 2). As used herein, the term "composite treatment fluid" generally refers to a treatment fluid comprising at least two component fluids. In such an embodiment, the two or more component fluids may be delivered into the wellbore separately, for example, via the first and second flowpaths, as will be disclosed herein, and substantially intermingled or mixed within the wellbore (e.g., in situ) so as to form the composite treatment fluid. Composite treatment fluids are disclosed in U.S. Publication No. 2010/0044041 to Smith et al., which is incorporated herein in its entirety.

In an embodiment, the composite treatment fluid may comprise a fracturing fluid (e.g., a composite fracturing fluid). In such an embodiment, the fracturing fluid may be formed from a first component fluid and a second component fluid. For example, in such an embodiment, the first component fluid may comprise a proppant-laden slurry (e.g., a concentrated proppant-laden slurry) and the second component may comprise a fluid with which the proppant-laden slurry may be mixed to yield the composite fracturing fluid, that is, a diluent (e.g., an aqueous fluid, such as water).

In an embodiment, the proppant-laden slurry (e.g., the first component) comprises a base fluid and a proppants. In an embodiment, the base fluid may comprise a substantially aqueous fluid. As used herein, the term "substantially aqueous fluid" may refer to a fluid comprising less than about 25% by weight of a non-aqueous component, alternatively, less than 20% by weight, alternatively, less than 15% by weight, alternatively, less than 10% by weight, alternatively, less than 5% by weight, alternatively, less than 2.5% by weight, alternatively, less than 1.0% by weight of a non-aqueous component. Examples of suitable substantially aqueous fluids include, but are not limited to, water that is potable or non-potable, untreated water, partially treated water, treated water, produced water, city water, well-water, surface water, or combinations thereof. In an alternative or additional embodiment, the base fluid may comprise an aqueous gel, a viscoelastic surfactant gel, an oil gel, a foamed gel, an emulsion, an inverse emulsion, or combinations thereof.

In an embodiment, the proppant may comprise any suitable particulate material. Examples of suitable proppants include, but are not limited to, graded sand, resin coated sand, bauxite, ceramic materials, glass materials, walnut hulls, polymeric materials, resinous materials, rubber materials, and the like. In an embodiment, the proppant may comprise at least one high density plastic. As used herein, the term "high density plastic" refers to a plastic having a specific gravity of greater than about 1. The density range may be from about 1 to about 2, alternatively, from about 1 to about 1.3, alternatively, from about 1.1 to 1.2. In an embodiment, the proppants may be of any suitable size and/or shape. For example, in an embodiment the proppants may have a size in the range of from about 2 to about 400 mesh, U.S. Sieve Series, alternatively, from about 8 to about 120 mesh, U.S. Sieve Series.

In an embodiment, the diluent (e.g., the second component) may comprise a suitable aqueous fluid, aqueous gel, viscoelastic surfactant gel, oil gel, a foamed gel, emulsion, inverse emulsion, or combinations thereof. For example, the diluent may comprise one or more of the compositions disclosed above with reference to the base fluid. In an embodiment, the diluent may have a composition substantially similar to that of the base fluid, alternatively, the diluent may have a composition different from that of the base fluid.

In an alternative embodiment, the composite treatment fluid may comprise any suitable alternative treatment fluid. An example of suitable alternative treatment fluid includes, but is not limited to, an acidizing fluid, a liquefied hydrocarbon gas, and/or a reactive fluid.

In an embodiment, a first component of the composite treatment fluid may be introduced into the wellbore via one of the first or second flowpaths and a second component of the composite treatment fluid may be introduced into the wellbore via the other of the first or second flowpaths. In an embodiment, the first and/or second components of the composite treatment may be introduced at rates so as to form a composite treatment fluid having a desired composition or character. For example, referring again to FIGS. 6A and 6B, in an embodiment a first component of the composite treatment fluid may be introduced into the wellbore (e.g., to a portion of the wellbore comprising the POES of the first treatment stage; in the embodiment of FIGS. 6A and 6B, the portion of the wellbore 114 substantially adjacent and/or proximate to formation zones 2, 4, 6, and 8) via either the first flowpath, as demonstrated by flow arrows A and C, or the second flowpath, as demonstrated by flow arrows B and D. Also, in such an embodiment, the second component of the composite treatment fluid may be introduced into the wellbore via the other flowpath (e.g., the flowpath via which the first component is not being communicated). For example, in an embodiment where the composite treatment fluid comprises a fracturing fluid, as disclosed herein, the proppant-laden fluid (e.g., a concentrated, proppant-laden fluid) may be introduced into the wellbore via the first flowpath, as demonstrated by flow arrows A and C (e.g., via the flowbore 171 of the work string 170), and the diluent (e.g., an aqueous or substantially aqueous fluid) may be introduced into the wellbore via the second flowpath, as demonstrated by flow arrows B and D (e.g., via the annular space defined by the work string 170 and the casing string 120).

In an embodiment, the first component of the composite treatment fluid may be introduced at a rate and/or pressure independent of the rate and/or pressure at which the second component of the composite treatment fluid is introduced. For example, in an embodiment, the relative quantities of the first component and the second component, which may combine to form the composite treatment fluid, may be varied. In such an embodiment, the composition and/or character of the resulting composite treatment fluid may be altered by altering the relative rates at which the first and second components are provided, as will be disclosed herein.

In an embodiment, the first component of the treatment fluid and the second component of the treatment fluid may be mixed, for example, to form the composite treatment fluid, within the wellbore. For example, referring again to FIGS. 6A and 6B, the first component and the second component (one being introduced into the wellbore 114 via the first flowpath, as demonstrated by flow arrows A and C, and the other being introduced into the wellbore 114 via the second flowpath, as demonstrated by flow arrows B and D) may come into contact within the wellbore 114, for example, within the portion of the wellbore proximate and/or substantially adjacent to the POEs of the first treatment stage (e.g., the POEs allowing fluid access to formation zones 2, 4, 6, and 8). In an embodiment, the first component and the second component may be mixed or substantially mixed within the wellbore 114 prior to entering the formation 102, while entering the formation 102 (e.g., via a POE 105), within the formation 102, or combinations thereof. As may be appreciated by one of skill in the art upon viewing this disclosure, and not intending to be bound by theory, the nature of the movement (e.g., fluid dynamics) of the first component, the second component, and the composite treatment fluid may contribute to the substantial mixing of the first and second component. For example, the movement of these fluids into, within, and out of the wellbore may result in turbulent fluid flows, non-laminar fluid flows, eddies, shearing forces, drag, or the like, one or more of which may contribute to the mixing or intermixing of the first component and the second component to form the composite treatment fluid.

In an embodiment, mixing the composite treatment fluid within the wellbore 114, as disclosed herein, may provide the operator with improved control over the composition of the composite treatment fluid. As noted above, the composition of the composite treatment fluid may be altered or adjusted by altering the relative amounts or concentrations of the first and second components, for example, by changing the relative rates at which the first and second components are pumped. Not intending to be bound by theory, although the pumping equipment may be located at the surface 104, increase or decreases in pumping rate made at the surface 104 may be realized substantially in real-time at the point of mixing of the composite treatment fluid, for example, like a syringe, the effectuated change in pumping rate is realized substantially immediately downhole. As such, the provision of the components of a composite treatment fluid into the wellbore in two flowpaths may allow an operator to have improved control over the composition and/or character of the composite treatment substantially more proximate in time to the entry of the treatment fluid in the formation.

Figure 7A:
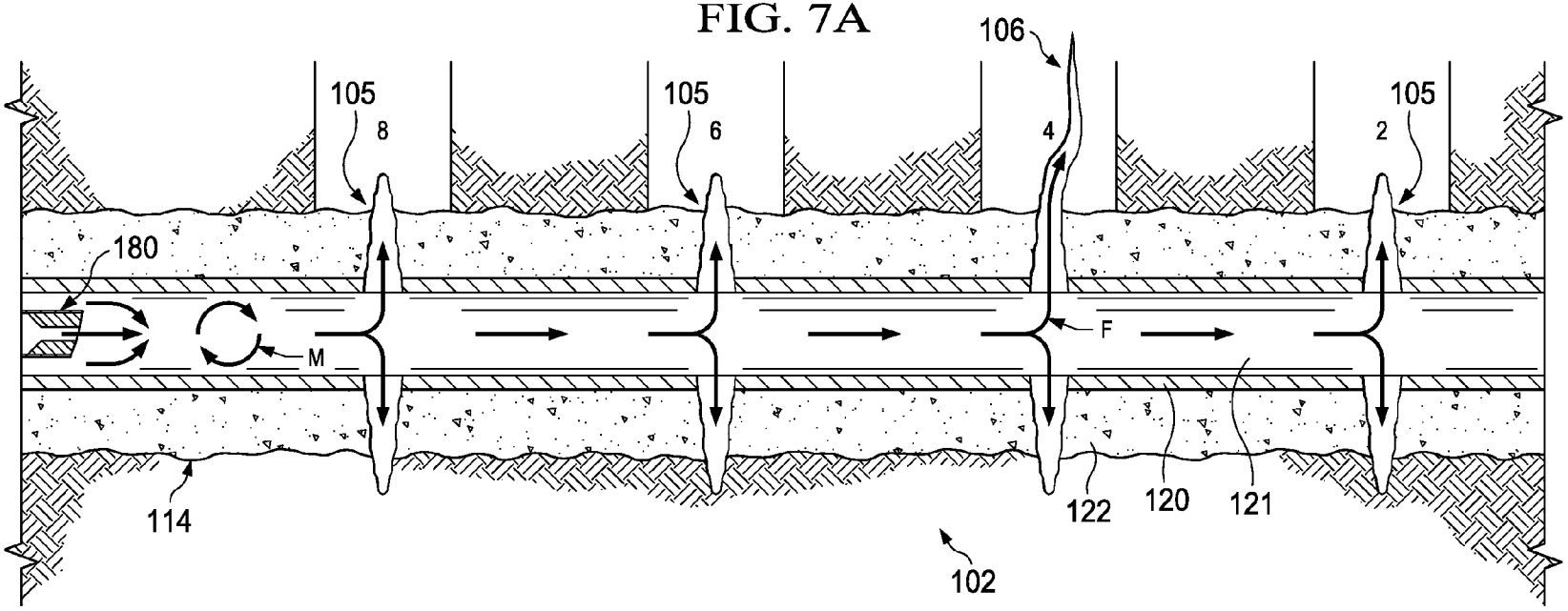
FIG. 7A is a cut-away view of an embodiment of a composite treatment fluid being introduced into a subterranean formation via a first flowpath.

In an embodiment, the composite treatment fluid may be introduced into the formation via a first flowpath into the formation (e.g., step 1500 in the embodiment of the MIT method 1000 of FIG. 2). For example, referring again to FIGS. 6A and 6B and as noted above, the composite treatment fluid may be formed within a portion of the wellbore 114 substantially adjacent or proximate to (and in fluid communication with) the downhole tools (e.g., 180/195) and/or the POEs 105 of the first treatment stage (e.g., the POEs substantially adjacent or proximate to formation zones 2, 4, 6, and 8). In the embodiment of FIG. 7A, a mixing zone is represented by flow arrows M. As such, the composite treatment fluid may be free to flow into these POEs and, additionally, into the formation (e.g., into formation zones 2, 4, 6, and 8).

In an embodiment, the first and second components may cumulatively be provided at a rate such that the composite treatment fluid (e.g., a fracturing fluid) may initiate and/or extend a fracture within the formation (e.g., within one or more of formation zones 2, 4, 6, and/or 8). For example, in an embodiment, the additive rate at which the first and second components of the treatment fluid are provided may equal and/or exceed the rate at which the composite fluid is lost to the formation 102. Additionally, in an embodiment, the additive rate at which the first and second components of the treatment fluid are provided may be sufficient to result in an increase in the pressure of the composite treatment fluid within the wellbore, for example, so as to meet and/or exceed a fracture initiation pressure or a fracture extension pressure in at least one of formation zones 2, 4, 6, or 8. As used herein, the term "fracture initiation pressure" may refer to the hydraulic pressure which may cause a fracture to form within a portion of a subterranean formation and the term "fracture extension pressure" may refer to the amount of hydraulic which will cause a fracture within a formation to be further extended within that formation.

In an embodiment, the composition and/or character of the composite treatment fluid may be varied or altered over the course of the treatment operation, as will be further disclosed herein. For example, in an embodiment, as the composite treatment fluid is initially introduced into the formation, for example, to initiate a fracture within one or more formation zones, the composite treatment fluid may comprise a relatively lesser amount of proppant or particulate material, alternatively, substantially no proppant or particulate material (e.g., a "pad" fluid). Also, in an embodiment, as a given fracture is extended with a formation zone, the relative amount of proppant within the composite treatment fluid may be increased. As noted above, the concentration of proppant within the composite treatment fluid may be varied by changing the relative rates at which the first and second components are provided into the wellbore for forming the composite fluid.

Not intending to be bound by theory, while the composite treatment fluid may be free to flow into any one of the POEs of the first fracturing stage (e.g., the wellbore may be in fluid communication with all POEs of the first fracturing stage), because the fracture initiation pressure and/or fracture extension pressure may vary between the formation zones of the first stage (e.g., formation zones 2, 4, 6, and 8), a fracture may form and/or be extended in the formation zone or zones requiring the lowest pressure for a fracture to form or be extended. That is, as the pressure increases within the wellbore due to continued pumping of the first and/or second fluid component, a fracture may form and/or extend within the first formation zone in which the fracture initiation and/or fracture extension pressure is reached. Again, not intending to be bound by theory, the composite treatment fluid may be said to follow a path or flowpath of least resistance.

Referring to FIG. 7A, such a first flowpath is illustrated. In the embodiment of FIG. 7A, the composite treatment fluid is illustrated entering the formation 102 via a first flowpath into the formation, particularly, into formation zone 4, as demonstrated by flow arrow F. For example, in the embodiment of FIG. 7A, the first flowpath into the formation (e.g., flow arrow F) comprises a POE and a fracture 106 (e.g., a fracture forming within the formation). While the embodiment of FIG. 7A illustrates the fracture 106 forming within formation zone 4, it should be recognized that a fracture (e.g., the first fracture to form) may similarly form in any one or more of formation zones 2, 6, or 8.

In an embodiment, as the composite treatment fluid is introduced into the formation and/or into one or more formation zones, the initiation and/or extension of any one or more fractures within the formation proximate to the POEs of the first treatment stage may be monitored (e.g., step 1600 in the embodiment of the MIT method 1000 of FIG. 2). In such an embodiment, the formation may be monitored by any suitable method and/or system, as may be appreciated by one of skill in the art upon viewing this disclosure. In such an embodiment, monitoring the formation may indicate, to an operator, the formation zones in which a fracture or fractures is being formed or extended during the communication of the composite treatment fluid.

In an embodiment, the formation (e.g., the formation proximate to the first fracturing stage) may be monitored via microseismic analysis. Not intending to be bound by theory, and as will be appreciated by one of skill in the art upon viewing this disclosure, during a hydraulic fracturing operation, the formation into which a fracture is being introduced undergoes significant stresses in proportion to the net treatment pressure and large changes in the pore pressure in proportion to the difference between the treatment pressure and the reservoir pressure. Both of these changes affect the stability of planes of weakness (such as natural fractures and bedding planes) adjacent to the hydraulic fracture, resulting in shear slippage. The shear slippages are analogous to earthquakes along faults (however, at a much lower amplitude) and, hence, the term "microseism," or microearthquake, has been used to described these slippages. As with earthquakes, microseisms emit elastic waves, but at much higher frequencies and generally within the acoustic frequency range. These elastic-wave signals can be detected using an appropriate transducer and analyzed for information regarding the source. Such microseismic measurements may be utilized to form images of fracture behavior during the performance of a treatment operation, such as a hydraulic fracturing operation. The microseismic data can be analyzed using one or more of at least two approaches. Warpinski at 336. A system for monitoring fracture initiation and/or extension may comprise one or more receivers, a telemetry system, and a processing unit. For example, where receivers are located in several wells, the microseismic locations can be triangulated based on the arrival times of the various waves and, with the knowledge of the formation velocities, the best-fit location of the activity may be determined. Alternatively, a single, vertical multi-level array of receiver may be employed to back-locate the microseismic source from a single, nearby offset well. Additional disclosure regarding microseismic analysis may be found in N. R. Warpinski, et al., *Mapping Hydraulic Fracture Growth and Geometry Using Microseismic Events Detected by a Wireline Retrievable Accelerometer Array*, SPE 40014 (1998), which is incorporated herein in its entirety. As such, in an embodiment, the location within the formation of fracturing activity may be available to the operator, for example, via the utilization of microseismic analysis.

Alternative methods and/or system of monitoring the formation may be appreciated by one of skill in the art upon viewing this disclosure. An example of such an alternative methodology includes, but is not limited to, distributed temperature sensing (DTS).

In an embodiment, the composite treatment fluid may be diverted from the first flowpath into the formation to a second flowpath into the formation (e.g., step 1700 in the embodiment of the MIT method 1000 of FIG. 2). For example, as noted above, by monitoring the initiation and/or extension of one or more fractures within the formation, the operator may be able to recognize the size, shape, geometry, orientation, or combinations thereof, of a fracture formed within the formation. In such an embodiment, for example, where the operator wishes to alter the size, shape, geometry, or orientation of the fracture, to cause the formation (e.g., initiation and/or extension) of another fracture within the same formation zone, or to cause the formation (e.g., initiation and/or extension) of another fracture within another formation zone, the operator may divert the composite treatment fluid from the first flowpath into the formation to a second flowpath into the formation.

Figure 7B:
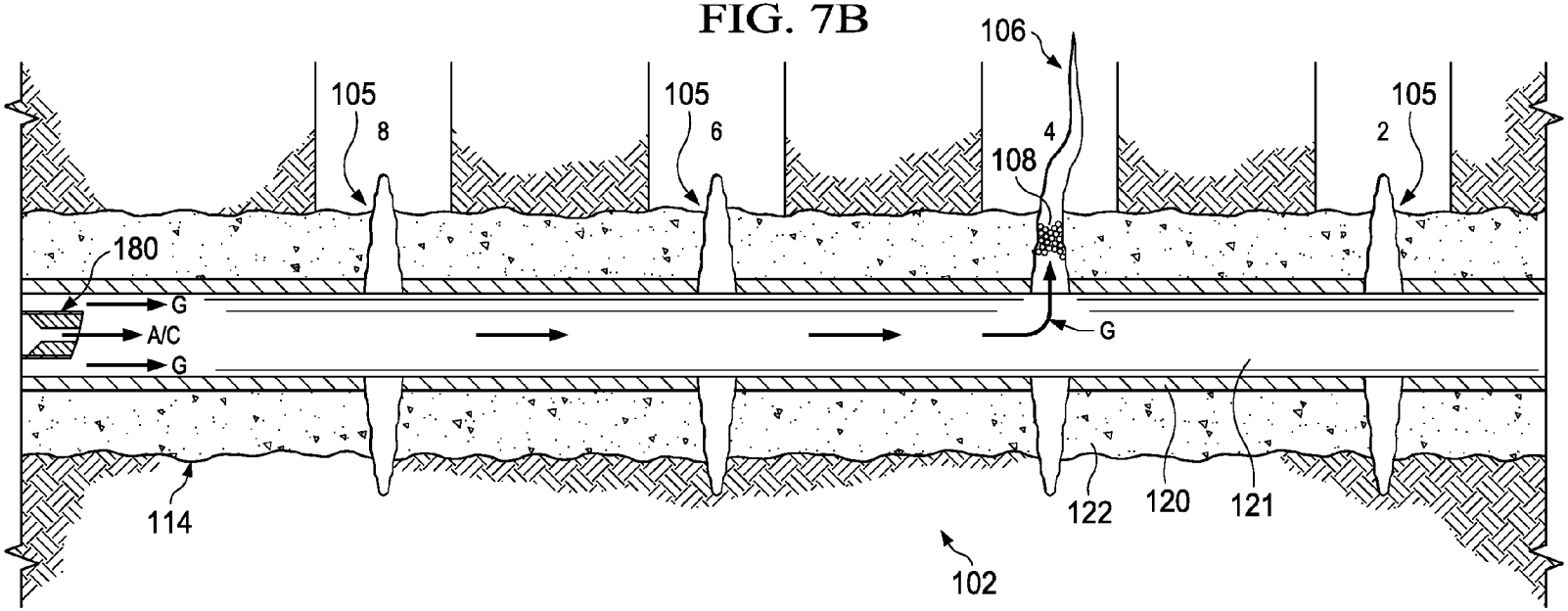
FIG. 7B is a cut-away view of an embodiment of a plug of diverter forming within the first flowpath into the formation of FIG. 7A.

Referring to FIG. 7B, in an embodiment, diverting the composite treatment fluid from the first flowpath into the formation to a second flowpath into the formation may comprise introducing a diverting fluid into the first flowpath. For example, in the embodiment of FIG. 7B, the diverting fluid is introduced into the wellbore 114 via the annular space defined by the work string and the casing string (e.g., the second flowpath into the wellbore, as disclosed above), although in an alternative embodiment the diverting fluid may be introduced via the flowbore of the work string (e.g., the first flowpath into the wellbore, as disclosed above). In the embodiment of FIG. 7B, the diverting fluid may flow into the wellbore 114 and, from the wellbore into the first flowpath into the formation as represented by flow arrow G (e.g., the POE and fracture into formation zone 4, in the embodiment of FIG. 7B). Additionally, in an embodiment, the diverting fluid may mix with a component of the composite fracturing fluid within the wellbore. For example, in the embodiment of FIGS. 7B and 7D, the diverting fluid is introduced into the wellbore (e.g., via the first flowpath, as represented by flow arrow G) while a component of the composite fluid (e.g., the proppant-laden slurry) is introduced into the wellbore (e.g., via the second flowpath, as represented by flow arrow A or flow arrow C) so as to mix with the diverting fluid prior to and/or substantially simultaneously with introduction into the formation and/or a zone thereof (e.g., via one or more POEs). In an alternative embodiment, the diverting fluid may be introduced into the formation and/or a zone thereof without any substantial mixing with another fluid and/or fluid component.

In an embodiment, the diverting fluid may generally comprise a diverter material, for example, in a slurry. The slurry may be formed from one or more diverter materials in combination with a substantially aqueous fluid, an oleaginous fluid, an emulsion fluid, an invert-emulsion fluid, or combinations thereof.

In an embodiment, the diverter may comprise any material suitable for distribution within or into a flowpath, for example, so as to form a pack or bridge and thereby cause fluid movement via that flowpath to cease or be reduced. For example, the diverter may comprise a material configured to increase the resistance to fluid via a given POE (e.g., into a given interval) such that fluid movement is diverted (e.g., redirected) to another POE (e.g., into another interval and/or via another flowpath into the same interval). In an embodiment, the diverter may comprise a suitable degradable material capable of undergoing an irreversible degradation downhole. As used herein, the term "irreversible" means that the degradable material, once degraded downhole, should not recrystallize or reconsolidate while downhole (e.g., the degradable material should degrade in situ but should not recrystallize or reconsolidate in situ. As used herein, the terms "degradation" or "degradable" may refer to either or both of heterogeneous degradation (or bulk erosion) and/or homogeneous degradation (or surface erosion), and/or to any stage of degradation in between these two. Not intending to be bound by theory, degradation may be a result of, inter alia, a chemical reaction, a thermal reaction, a reaction induced by radiation, or combinations thereof.

In an embodiment, the degradable material may comprise degradable polymers, dehydrated salts, or combinations thereof.

In an embodiment where the degradable material comprises a degradable polymer, such a degradable polymer may generally comprise a polymer that degrades due to, inter alia, a chemical and/or radical process such as hydrolysis, oxidation, or UV radiation. As may be appreciated by one of skill in the art upon viewing this disclosure, the degradability of a polymer may depend at least in part on its backbone structure. For example, the presence of hydrolyzable and/or oxidizable linkages within the backbone structure may yield a material that will degrade as described herein. As may also be appreciated by one of skill in the art upon viewing this disclosure, the rates at which such polymers degrade may be at least partially dependent upon the type of repetitive unit, composition, sequence, length, molecular geometry, molecular weight, morphology (e.g., crystallinity, size of spherulites, and orientation), hydrophilicity, hydrophobicity, surface area, and additives. Additionally, the environment to which a given polymer is subjected may also influence how it degrades, (e.g., temperature, presence of moisture, oxygen, microorganisms, enzymes, pH, the like, and combinations thereof).

Examples of suitable degradable polymers include, but are not limited to, those described in the publication of Advances in Polymer Science, Vol. 157 entitled "Degradable Aliphatic Polyesters" edited by A. C. Albertsson, which is incorporated herein in its entirety. Specific examples include, but are not limited to, homopolymers, random, block, graft, star- and hyper-branched aliphatic polyesters, and combinations thereof. Polycondensation reactions, ring-opening polymerizations, free radical polymerizations, anionic polymerizations, carbocationic polymerizations, coordinative ring-opening polymerization, and any other suitable process may be utilized to prepare such suitable polymers. Specific examples of suitable polymers include, but are not limited to, polysaccharides such as dextran or cellulose; chitins; chitosans; proteins; aliphatic polyesters; poly(lactides); poly(glycolides); poly(ε-caprolactones); poly (hydroxybutyrates); poly(anhydrides); aliphatic polycarbonates; poly(orthoesters); poly(amino acids); poly(ethylene oxides); polyphosphazenes, and combinations thereof.

Aliphatic polyesters may degrade chemically, for example, by hydrolytic cleavage. Hydrolysis can be catalyzed by either acids or bases. Not intending to be bound by theory, during hydrolysis, carboxylic end groups are formed during chain scission, and this may enhance the rate of further hydrolysis. This mechanism is known in the art as "autocatalysis," and is thought to make polyester matrices more bulk eroding.

In an embodiment, a suitable aliphatic polyester may be represented by the general formula of repeating units shown below:

Formula I

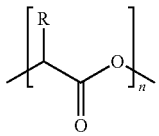

where n is an integer between 75 and 10,000 and R is selected from the group consisting of hydrogen, alkyl, aryl, alkylaryl, acetyl, heteroatoms, or combinations thereof. In an embodiment, such an aliphatic polyesters may comprise poly(lactide). Poly(lactide) may be synthesized either from lactic acid by a condensation reaction or by a ring-opening polymerization of a cyclic lactide monomer. Because both lactic acid and lactide can achieve the same repeating unit, the general term poly(lactic acid) as, used herein refers, to Formula I without any limitation as to how the polymer was made such as from lactides, lactic acid, or oligomers, and without reference to the degree of polymerization or level of plasticization.

Such a lactide monomer may exist, generally, in one of three different forms: two stereoisomers L- and D-lactide and racemic D,L-lactide (meso-lactide). The oligomers of lactic acid, and oligomers of lactide may be represented by the general formula:

Formula II

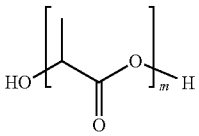

where m is an integer $2 \leq m \leq 75$, alternatively, m is an integer and $2 \leq m \leq 10$. In such an embodiment, the molecular weight may be below about 5,400, alternatively, below about 720, respectively. In an embodiment, the chirality of the lactide units may provide a means by which to adjust, inter alia, degradation rates, as well as physical and mechanical properties. For example, poly(L-lactide) is a semicrystalline polymer with a relatively slow hydrolysis rate. This could be desirable in applications where a slower degradation of the degradable particulate is desired. In another embodiment, poly(D,L-lactide) may be a relatively more amorphous polymer with a resultant faster hydrolysis rate. This may be desirable for other applications where a more rapid degradation may be appropriate. The stereoisomers of lactic acid may be used individually or combined to be used in accordance with the present invention. In an additional embodiment, one or more stereoisomers of lactic acid may be copolymerized with, for example, glycolide or other monomers like ϵ-caprolactone, 1,5-dioxepan-2-one, trimethylene carbonate, or other suitable monomers, for example, so as to obtain polymers with different properties (e.g., degradation time). In yet another additional embodiment, the lactic acid stereoisomers can be modified to be used in the present invention by, inter alia, blending, copolymerizing or otherwise mixing the stereoisomers, blending, copolymerizing or otherwise mixing high and/or low molecular weight polylactides, or by blending, copolymerizing or otherwise mixing a polylactide with another polyester or polyesters.

In an embodiment, the polymeric degradable materials may further comprise a plasticizer. In such an embodiment, the plasticizer may be present in an amount sufficient to provide one or more desired characteristics, for example, (a) more effective compatibilization of the melt blend components, (b) improved processing characteristics during the blending and processing steps, (c) control and regulation of the sensitivity and degradation of the polymer by moisture, or combinations thereof. Suitable plasticizers may include, but are not limited to, derivatives of oligomeric lactic acid, selected from the group represented by the formula:

Formula III

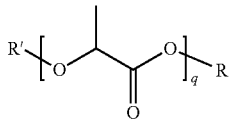

where R is a hydrogen, alkyl, aryl, alkylaryl, acetyl, heteroatom, or combinations thereof and R is saturated, where R' is a hydrogen, alkyl, aryl, alkylaryl, acetyl, heteroatom, or combinations thereof and R' is saturated, where R and R' cannot both be hydrogen, where q is an integer and $2 \leq q \leq 75$, alternatively, $2 \leq q \leq 10$. As used herein the term "derivatives of oligomeric lactic acid" may include derivatives of oligomeric lactide. In an additional embodiment, such a plasticizer may enhance the degradation rate of the degradable polymeric materials. In an embodiment where such a plasticizer is used, the plasticizer may be intimately incorporated within the degradable polymeric materials.

Suitable aliphatic polyesters may be prepared by any suitable method, such as those described in U.S. Pat. Nos. 6,323,307; 5,216,050; 4,387,769; 3,912,692; and 2,703,316, each of which is incorporated herein in its entirety.

In an alternative embodiment, the degradable polymer may comprise a polyanhydride. Not intending to be bound by theory, polyanhydride hydrolysis may proceed, inter alia, via free carboxylic acid chain-ends to yield carboxylic acid as a final degradation product. The erosion time can be varied over a broad range of changes in the polymer backbone. Examples of suitable polyanhydrides include, but are not limited to, poly(adipic anhydride), poly(suberic anhydride), poly(sebacic anhydride), poly(dodecanedioic anhydride), or combinations thereof. Additional examples include, but are not limited to, poly(maleic anhydride) and poly(benzoic anhydride).

In an embodiment, the physical properties associate with a degradable polymer may depend upon several factors including, but not limited to, the composition of the repeating units, the flexibility of the chain, the presence or absence of polar groups, the molecular mass, the degree of branching, the crystallinity, orientation, or the like. For example, short chain branches may reduce the degree of crystallinity of polymers while long chain branches may lower the melt viscosity and impart, inter alia, elongational viscosity with tension-stiffening behavior. The properties of the degradable material may be further tailored by blending, and copolymerizing the degradable material with another polymer, or by a change in the macromolecular architecture (e.g., hyperbranched polymers, star-shaped, or dendrimers, etc.). The properties of any such suitable degradable polymers (e.g., hydrophobicity, hydrophilicity, rate of degradation, etc.) can be tailored by introducing select functional groups along the polymer chains. For example, poly(phenyllactide) will degrade at about ⅕th of the rate of racemic poly(lactide) at a pH of 7.4 at 55° C. One of ordinary skill in the art with the benefit of this disclosure will be able to determine the appropriate degradable polymer to achieve one or more desired physical properties of the degradable polymers.

In an alternative embodiment, the degradable material may comprise a dehydrated salt. In such an embodiment, a suitable dehydrated salt generally refers to a salt that will degrade (e.g., over time) as it hydrates. An example of a dehydrated salt that degrades as it hydrates is a particulate solid anhydrous borate material. Specific examples of such a particulate solid anhydrous borate include, but are not limited to, anhydrous sodium tetraborate (also known as anhydrous borax), anydrous boric acid, or combinations thereof. Such anhydrous borate materials may be characterized as only slightly soluble in water. However, in a subterranean environment, the anhydrous borate materials may react with the surrounding aqueous fluid to be hydrated. The resulting hydrated borate materials are highly soluble in water as compared to anhydrous borate materials and, as a result, degrade in the aqueous fluid. In some instances, the total time required for the anhydrous borate materials to degrade in an aqueous fluid is in the range of from about 8 hours to about 72 hours depending upon the temperature of the subterranean zone in which they are placed. Other examples of a suitable dehydrated salt include organic or inorganic salts like acetate trihydrate.

In an embodiment, the degradable material may comprise a suitable blend. An example of a suitable blend of degradable materials is the combination of poly(lactic acid) and sodium borate. Another example of a suitable blend of degradable materials is the combination of poly(lactic acid) and boric oxide.

In an embodiment, in choosing the appropriate degradable material, an operator may consider the degradation products that will result. For example, an operator may choose the degradable materials such that the resulting degradation products do not adversely affect one or more other operations, treatment components, the formation, or combinations thereof. For example, the choice of degradable material may also depend, at least in part, upon the conditions of the well, for example, wellbore temperature. For example, some lactides may be suitable for use in lower temperature wells (e.g., including those within the range of 60° F. to 150° F.). Also, some polylactides may be suitable for well bore temperatures above this range. Also, poly(lactic acid) may be suitable for higher temperature wells. For example, some stereoisomers of poly(lactide) or combinations of such stereoisomers may be suitable for even higher temperature applications. Dehydrated salts may also be suitable for higher temperature wells.

Examples of suitable diverters commercially available from Halliburton Energy Services include, but are not limited to, BioVert, which is biodegradable material such as poly(lactide), Perf balls, which are solid non-biodegradable materials such as rubber-coated nylon balls, or BioBalls, which are biodegradable balls.

The specific features of the diverter may be chosen or modified to provide a desired size, shape, or the like. For example, in an embodiment, the degradable materials may comprise particles having sizes ranging from about 10 mesh to about 100 mesh, alternatively, from about 10 mesh to about 40 mesh, alternatively, from about 80 mesh, to about 120 mesh. Also, in various embodiments, the degradable materials may have any suitable shape. Suitable shapes may include, but are not limited to, particles having the physical shape of platelets, shavings, flakes, ribbons, rods, strips, spheroids, toroids, pellets, tablets, or any other physical shape. In an embodiment, the size and/or shape of the degradable material may be chosen so as to provide a pack or bridge within a given flowpath (e.g., within a POE and/or at a given distance from the wellbore within a fracture) having a given size, shape, and/or orientation.

For example, as noted above, in an embodiment the diverting fluid may form a pack or bridge of the diverter within a given flowpath, and thereby cause fluid movement via that flowpath to cease or be reduced. As such, movement of fluid via that flowpath may be diverted to another flowpath. For example, referring again to FIG. 7B, the diverting fluid is introduced into the wellbore 114 and, from the wellbore 114, the diverting fluid may be introduced into the first flowpath into the formation, as represented by flow arrow G (the POE and fracture 106 into formation zone 4 in the embodiment of FIG. 7B). In an embodiment, as the diverting fluid enters the first flowpath into the formation, the diverter may form a pack 108. In various embodiments, such a pack within the fracture 106 (e.g., at some distance from the wellbore), within the POE 105, within the wellbore, or combinations thereof, as will be disclosed.

Figure 7C:
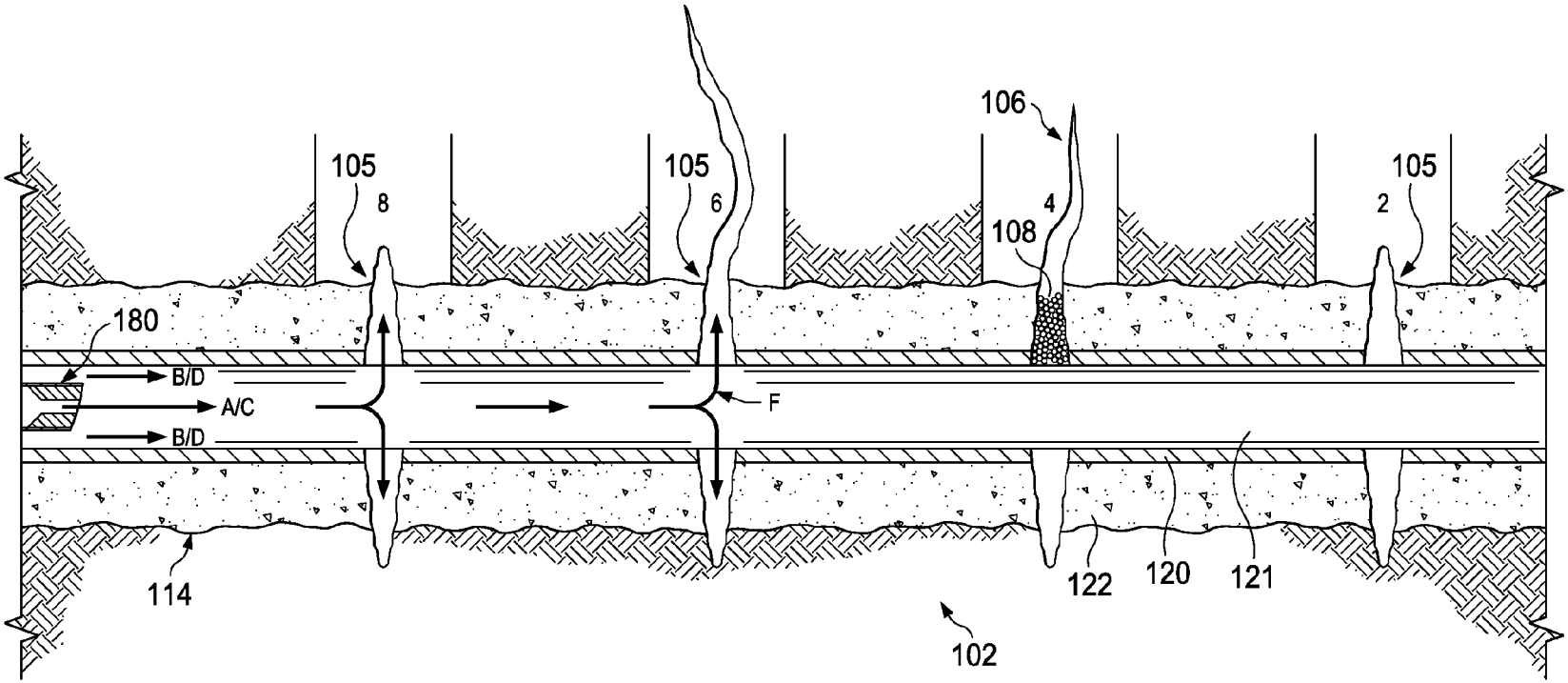
FIG. 7C is a cut-away view of an embodiment of a composite treatment fluid being introduced into a subterranean formation via a second flowpath following the formation of the diverter plug of FIG. 7B.

In the embodiment of FIG. 7B, the pack 108 forms within the POE of the first flowpath and/or within the fracture 106 within a relatively short distance from the wellbore 114, for example, less than a radius of about 10 feet from the wellbore (e.g., "near-field"). Referring to FIG. 7C, in an embodiment where the pack 108 forms within the POE of the first flowpath and/or within the fracture 106 within a relatively short distance from the wellbore 114 (e.g., as illustrated in FIG. 7B), the treatment fluid may be diverted to a second flowpath into the formation comprising another POE, as represented by flow arrow F, thereby causing a fracture to be initiated or extended within another formation zone (e.g., formation zone 6, in the embodiment illustrated in FIG. 7C).

Figure 7D:
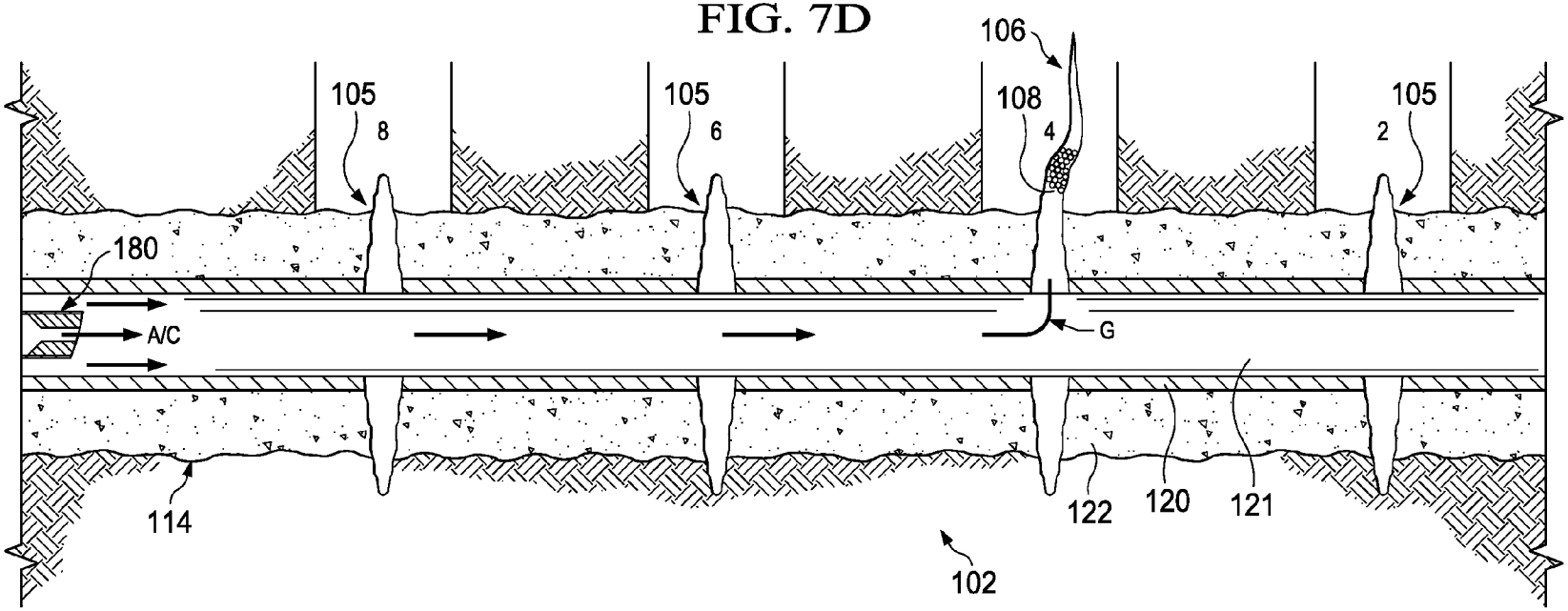
FIG. 7D is a cut-away view of an alternative embodiment of a plug of diverter forming within the first flowpath into the formation of FIG. 7A.
Figure 7E:
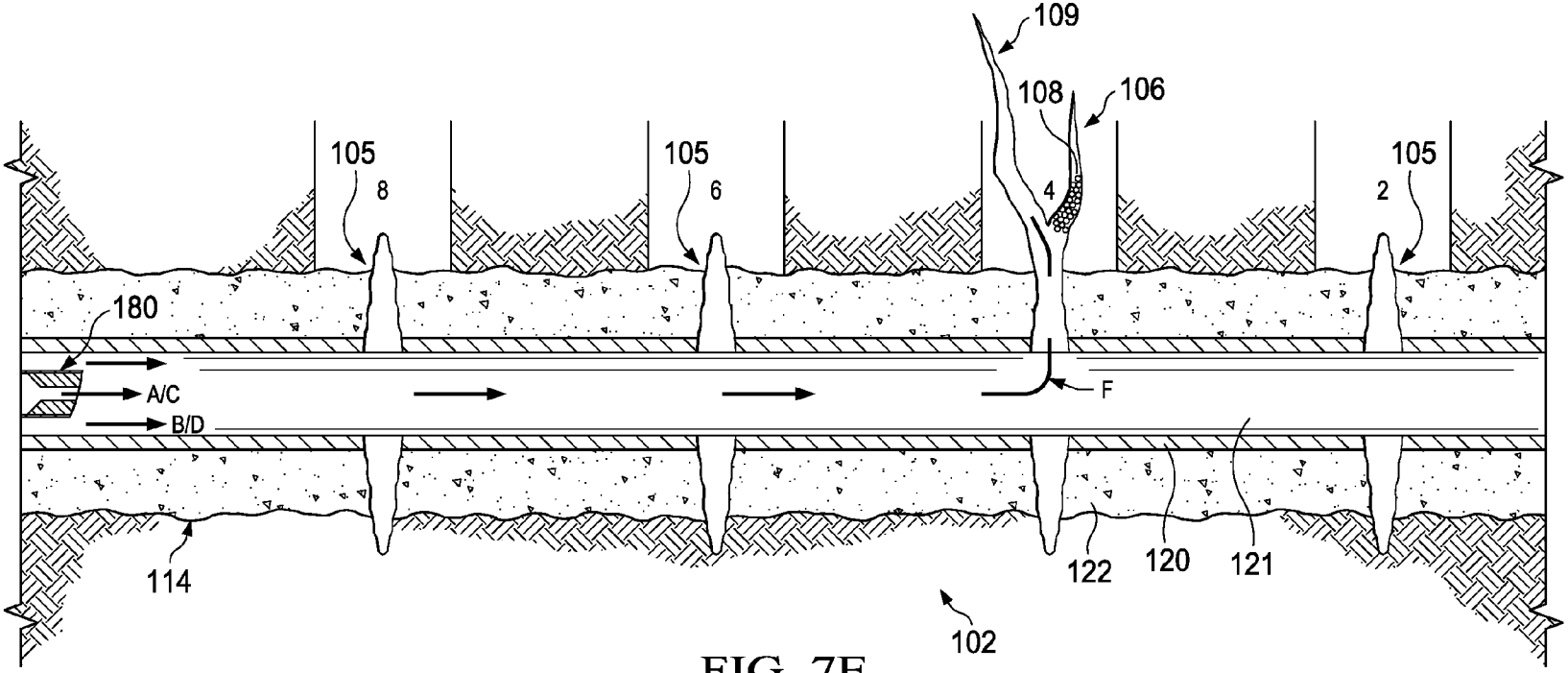
FIG. 7E is a cut-away view of an alternative embodiment of a composite treatment fluid being introduced into the subterranean formation via a second flowpath following the formation of the diverter plug of FIG. 7D.

In an alternative embodiment, referring to FIG. 7D, the diverting fluid is introduced into the wellbore 114 and, from the wellbore 114, the diverting fluid may be introduced into the first flowpath into the formation, as represented by flow arrow G. In the embodiment of FIG. 7D, the pack 108 forms within the fracture 106 at a relatively greater distance from the wellbore 114 (e.g., relative to the embodiment of FIGS. 7B and 7C), for example, greater than a radius of about 10 feet from the wellbore (e.g., "far-field"). Referring to FIG. 7E, in an embodiment where the pack 108 forms within the fracture 106 at a relatively greater distance from the wellbore 114, the treatment fluid may be diverted to a second flowpath into the formation comprising a new fracture or a branched fracture 109 within the same formation zone (e.g., formation zone 4, in the embodiment illustrated in FIG. 7E.

In an embodiment, as noted above, the diverting agent may be configured, for example, via selection of a given size and/or shape, as may be appreciated by one of skill in the art upon viewing this disclosure, for placement at a given position (e.g., distance from the wellbore) within such a flowpath. Not intending to be bound by theory, where it is desired that a diverter pack (e.g., diverter pack 108, as illustrated in FIGS. 7B and 7C) form relatively nearer the wellbore, the diverter may be selected so as to have a relatively larger size; alternatively, where it is desired that a diverter pack (e.g., diverter pack, as illustrated in FIGS. 7D and 7E) for relatively farther from the wellbore (e.g., far-field), the diverter may be selected so as to have a relatively larger size. Again, not intending to be bound by theory, relatively smaller diverter particles may be carried a relatively greater distance into the formation (e.g., into an existing and/or extending fracture). As such, the diverting fluid may be formed such that the plug of diverter will form at a desired location within a given flowpath and, for example, so as to influence the flowpath to fluid the treatment fluid is diverted.

In an embodiment, after an amount of diverting fluid sufficient to effect diversion of the treatment fluid to a second flowpath has been delivered into the first flowpath into the formation, delivery of a servicing fluid (e.g., a fracturing fluid such as the composite treatment fluid, as disclosed herein) may be resumed. The treatment fluid may be introduced into the formation until the operator wishes to divert the treatment fluid to a third flowpath into the formation. As such, the process of introducing a treatment fluid into the formation to create a flowpath (e.g., a fracture) and, thereafter, diverting the treatment fluid to another flowpath into the formation and/or to a different location or depth within a given flowpath may be continued until the formation zones proximate to the zones of the first fracturing stage have been fractured to the extent desired by an operator.

In an embodiment, for example, an embodiment where the formation is to be treated in multiple stages (e.g., two, three, four, five, six, or more treatment stages, as disclosed herein), when it is desired to begin treatment of a second stage, for example, when treatment of the first treatment stage has been completed, the flowpaths (e.g., the POES of the first treatment stage) may be plugged and/or packed off, for example, so as to plug fluid flow into and/or via the first treatment stage. For example, in an embodiment, one of more of the fluid flowpaths into or via the first treatment stage may be ceased by placement of a plug, such as a packer (e.g., a swellable or mechanical packer, such as a fracturing plug) or a particulate plug, such as a sand plug (e.g., by introduction of a concentrated particulate slurry). As such, the POEs of the second treatment stage may be isolated from the POEs of the second, third, fourth, etc., treatment stage.

Following isolation of the second treatment stage from any POEs located further downhole, one or more of the steps of selecting the second treatment stage, providing the wellbore having the plurality of POEs, preparing for the introduction of the treatment fluid via the POEs of the second stage, forming the composite treatment fluid within the wellbore proximate to the second treatment stage, introducing the composite treatment fluid in the formation via a first flowpath (e.g., a first flowpath of the second stage) into the formation, monitoring fracture initiation and/or extension within the formation proximate and/or substantially adjacent to the second treatment stage, and diverting the treatment fluid from the first flowpath (e.g., the first flowpath of the second stage) into the formation to a second flowpath (e.g., a second flowpath of the second stage) into the formation may performed with respect to the second treatment stage, for example, as disclosed herein with respect to the first treatment stage. As disclosed herein, the first and second flowpaths of the second treatment stage may be into different zones (e.g., as disclosed with respect to FIGS. 7B and 7C) or into the same zone (e.g., as disclosed with respect to FIGS. 7D and 7E).

In an additional embodiment, the portions of the MIT method may be repeated with respect to each of a third, fourth, fifth, sixth, or more, treatment stages, for example, as disclosed herein with respect to the first treatment stage.

In an embodiment, following completion of the treatment of the subterranean formation or some number of zones thereof, for example, treatment via the disclosed MIT method 1000, the wellbore and/or the subterranean formation may be prepared for production, for example, production of a hydrocarbon, therefrom.

In an embodiment, preparing the wellbore and/or formation for production may comprise removing diverter material from one or more flowpaths, for example, by allowing diverter material therein to degrade. As noted above, the diverter may be introduced into one or more flowpaths during the performance of the MIT method 1000 disclosed herein, for example, so as to restrict fluid communication via that particular flowpath and, thereby, divert fluid movement to another flowpath. In such an embodiment, the diverter may be allowed to degrade, thereby permitting fluid movement via the flowpaths extending between the wellbore and the formation and opening these flowpaths for the communication of a production fluid, such as a hydrocarbon. As noted above, the diverter (e.g., a degradable material) may be selected and/or otherwise configured such that the diverter will degrade (e.g., thereby re-establishing and/or improving fluid communication between the wellbore and the formation) within a desired and/or preselected time-range. For example, the diverter may be configured and/or selected such that at least 75% by volume, alternatively, at least 85%, alternatively, at least 95%, alternatively, at least 99%, of the diverter will degrade within such a suitable time-range. In an embodiment, such a suitable time-range may be from about 4 hours to about 100 hours, alternatively, from about 8 hours to about 80 hours, alternatively, from about 10 hours to about 60 hours.

In an additional embodiment, preparing the wellbore and/or formation for production may comprise drilling out the wellbore, milling out the wellbore, cleaning or washing out the wellbore, or combinations thereof. As noted above, during the treatment of the wellbore and/or the subterranean formation, one or more plugs (e.g., fracturing plugs, bridge plugs, sand plugs, or the like) may be set within the wellbore, for example, to impede fluid communication through certain portions of the wellbore and/or the formation, for example, between successive treatment stages of an entire treatment operation. In such an embodiment, one or more of such plugs may be removed, for example, such that fluids produced from the formation (e.g., hydrocarbons) may freely flow into and via the wellbore, for example, so as to be withdrawn from the wellbore. In an embodiment, any such drilling, milling, and/or cleaning operation may be performed employing any suitable process or apparatus, as may be appreciated by one of skill in the art upon viewing this disclosure.

In an embodiment, a wellbore servicing method, such as the MIT method 1000 disclosed herein or some portion thereof, may be an advantageous means by which to treat a subterranean formation. For example, a treatment method, such as the MIT method 1000, may be employed to simultaneously or substantially contemporaneously treat multiple zones of a single formation. As disclosed herein, such a method of treatment may allow an operator to treat multiple zones, for example, via multiple POEs, by selectively diverting the movement of a treatment fluid from a given flowpath into the formation to another flowpath into the formation. For example, by employing a method, such as the MIT method disclosed herein, an operator may be able to service 2, 3, 4, 5, 6, 7, 8, 9, 10, 11, 12, or more zones during a single, substantially continuous treatment stage, as disclosed herein. As may be appreciated by one of skill in the art, conventional methods of treatment have not included simultaneously or substantially contemporaneously servicing such a number of zones in that, because of the heterogeneity between various zones of a given formation (e.g., because various zones often exhibit differing fracture initiation and/or fracture extension pressures), a first zone may receive treatment fluid while a second zone does not (e.g., the first zone is the dominant zone or fracture). As such, conventional methods and/or systems have not provided a way in which to ensure that all zones received the treatment fluid. Rather, conventional treatment methods rely on limiting the number of POEs for each stage, often to a single POE or a limited number of POEs, in an effort to provide sufficient power and fluid-flow to treat via each POE. Therefore, the treatment methods disclosed herein surprisingly provide a means by which to treat one or more formations via multiple POEs while requiring less power and while necessitating lower overall flowrates.

Additionally, conventional methods of refracturing (e.g., extending existing fractures) a formation have similarly been unsuccessful in that, because the fracture extension pressure varies between various zones of a formation, such conventional methods have been unable to divert treatment fluid from zones having lesser extension pressures to zones have relatively higher extension pressures. As such, the instantly disclosed methods (e.g., the MIT method 1000) allow operators to treat multiple methods during a single treatment stage while assuring that each of the zones, as desired for a given operation, receives the treatment fluid so as to treat (e.g., stimulate) a particular zone of that formation.

Further still, in an embodiment, the instantly disclosed methods may provide an operator with the ability to more quickly and efficiently manage contingencies that may occur during treatment. For example, because the instantly disclosed methods utilize multiple flowpaths into and/or out of the wellbore, in the event of such a contingency (e.g., a screen-out, over-diversion, unintended diversion, or the like), the methods disclosed herein may enable the operator to remediate, for example, by reverse-circulating, cleaning-out, or the like (e.g., using one or both flowpaths) some portion of the wellbore, for example, so as to recover at least a portion of a diverting fluid that has been placed within the wellbore and/or within the formation and, thereby, enabling the operator to resume treatment operations.

In an additional embodiment, the instantly disclosed methods may allow a servicing operation to be performed more quickly and efficiently, in relation to conventional methods of wellbore servicing. For example, because multiple zones may be serviced simultaneously and/or substantially contemporaneously, the number of times that downhole tools must be reconfigured (e.g., switched from a perforating configuration to a fracturing configuration) may be lessened. For example, in the performance of convention methods, each reconfiguration of a downhole tool (e.g., such as the tools disclosed herein) required running-in and/or running-out a mechanical shifting tool or a signaling member, such as the obturating member disclosed herein (e.g., a ball or dart), thereby requiring a significant amount of time. As such, the ability to service multiple zones with minimal reconfigurations of downhole tools saves valuable time and resources, making the overall servicing operation significantly more efficient.

ADDITIONAL DISCLOSURE

The following are nonlimiting, specific embodiments in accordance with the present disclosure:

Embodiment A

A method of servicing a subterranean formation comprising: providing a wellbore penetrating the subterranean formation and having a casing string disposed therein, the casing string comprising a plurality of points of entry, wherein each of the plurality of points of entry provides a route a fluid communication from the casing string to the subterranean formation;

introducing a treatment fluid into the subterranean formation via a first flowpath; and diverting the treatment fluid from the first flowpath into the formation to a second flowpath into the formation.

Embodiment B

The method of embodiment A, wherein one or more of the points of entry comprises a perforation.

Embodiment C

The method of one of embodiments A or B, wherein one or more of the point of entry comprises a casing window.

Embodiment D

The method of one of embodiments A through C, wherein providing a wellbore having the casing string comprising the plurality of points of entry comprises:

positioning a fluid jetting apparatus within the casing string, wherein the fluid jetting apparatus is attached to a work string;

configuring the fluid jetting apparatus to emit a perforating fluid; and operating the fluid jetting apparatus so as to introduce one or more perforations within the casing string.

Embodiment E

The method of one of embodiments A through D, wherein providing a wellbore having the casing string comprising the plurality of points of entry comprises:

shifting a casing window assembly from a first configuration in which the casing window assembly does not provide a route of fluid communication from the casing string to the subterranean formation to a second configuration in which the casing window assembly provides a route of fluid communication from the casing string to the subterranean formation, wherein the casing window assembly is incorporated within the casing string.

Embodiment F

The method of embodiment E, wherein shifting the casing window from the first configuration to the second configuration comprises:

positioning a mechanical shifting tool within the casing string, wherein the mechanical shifting tool is attached to a work string;

actuating the mechanical shifting tool, wherein actuating the mechanical shifting tool causes the mechanical shifting tool to engage a sliding sleeve of the casing window assembly; and moving the sliding sleeve so as to unobscure one or more fluid ports of the casing window assembly.

Embodiment G

The method of one of embodiments A through F, wherein the treatment fluid comprises a composite treatment fluid, and further comprising forming the treatment fluid within the wellbore.

Embodiment H

The method of one of embodiments A through G, wherein forming the composite treatment fluid within the wellbore comprises:

introducing a first fluid component into the wellbore via a first flowpath into the wellbore;

introducing a second fluid component into the wellbore via a second flowpath into the wellbore; and mixing the first component and the second component within the wellbore.

Embodiment I

The method of embodiment H, wherein the first flowpath into the wellbore comprises a flowbore defined by a workstring and the second flowpath into the wellbore comprises an annular space between the casing string and the workstring.

Embodiment J

The method of embodiment I, wherein the first fluid component comprises a concentrated proppant-laden slurry, wherein the second fluid component comprises a diluent, and wherein the composite treatment fluid comprises a fracturing fluid.

Embodiment K

The method of one of embodiments A through J, wherein diverting the composite treatment fluid from the first flowpath into the formation to a second flowpath into the formation comprises introducing a diverting fluid into the first flowpath into the formation.

Embodiment L

The method of embodiment K, wherein the diverting fluid comprises a diverter, wherein the diverter comprises a degradable material.

Embodiment M

The method of embodiment L, wherein the diverter comprises a degradable polymer, a dehydrated salt, or combinations thereof.

Embodiment N

The method of one of embodiments L or M, wherein the diverter comprises poly(lactic acid).

Embodiment O

The method of one of embodiments L or M, wherein introducing the diverting fluid into the first flowpath into the formation causes the formation of a plug of diverter within the first flowpath into the formation.

Embodiment P

The method of embodiment O, wherein the first flowpath into the formation comprises one of the plurality of points of entry, wherein the plug forms within the point of entry of the first flowpath into the formation.

Embodiment Q

The method of embodiment P, wherein the second flowpath into the formation comprises a point of entry different from the point of entry of the first flowpath into the formation.

Embodiment R

The method of one of embodiments O through Q, wherein the plug forms within the formation.

Embodiment S

The method of embodiment R, wherein the second flowpath into the formation comprises a fracture within the same zone of the subterranean formation as the first flowpath into the formation.

Embodiment T

The method of one of embodiments A through S, further comprising monitoring the subterranean formation as the composite treatment fluid is introduced therein.

Embodiment U

The method of embodiment T, wherein the subterranean formation is monitored using microseismic analysis.

Embodiment V

The method of one of embodiments A through U, further comprising:

introducing the composite treatment fluid into the subterranean formation via the second flowpath; and diverting the composite treatment fluid from the second flowpath into the formation to a third flowpath into the formation.

Embodiment W

The method of embodiment K, further comprising:

recovering at least a portion of the diverting fluid from the first flowpath into the formation; and introducing an additional quantity of the composite fluid into the first flowpath into the formation.

Embodiment X

A method of servicing a subterranean formation comprising:

providing a plurality of points of entry into the subterranean formation associated with a first stage of a wellbore servicing operation;

introducing a composite treatment fluid into the subterranean formation via a first of the plurality of points of entry into the formation associated with the first stage;

introducing a diverting fluid into the first of the plurality of points of entry into the formation, wherein introducing a diverting fluid into the first of the plurality of points of entry into the formation associated with the first stage causes the composite treatment fluid to be diverted from the first of the plurality of points of entry associated with the first stage to a second of the plurality of points of entry associated with the first stage; and introducing the composite treatment fluid into the subterranean formation via the second of the plurality of points of entry into the formation associated with the first stage.

Embodiment Y

The method of embodiment X, wherein the diverting fluid comprises a diverter, wherein the diverter comprises a degradable material.

Embodiment Z

The method of embodiment Y, wherein the diverter comprises a degradable polymer, a dehydrated salt, or combinations thereof.

Embodiment AA

The method of one of embodiments X through Z, further comprising isolating the plurality of points of entry into the subterranean formation associated with the first stage from a second stage.

Embodiment AB

The method of embodiment AA, further comprising introducing a composite treatment fluid into the subterranean formation via a first of a plurality of points of entry into the formation associated with the second stage; and introducing a diverting fluid into the first of the plurality of points of entry into the formation associated with the second stage, wherein introducing a diverting fluid into the first of the plurality of points of entry into the formation associated with the second stage causes the composite treatment fluid to be diverted from the first of the plurality of points of entry associated with the second stage to a second of the plurality of points of entry associated with the second stage.

Embodiment AC

The method of embodiment AA, wherein isolating the plurality of points of entry into the subterranean formation associated with the first stage from the second stage comprises setting a particulate plug.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of servicing a subterranean formation comprising:

providing a wellbore penetrating the subterranean formation and having a casing string disposed therein, the casing string comprising a plurality of points of entry, wherein each of the plurality of points of entry provides a route of fluid communication from the casing string to the subterranean formation;

forming a composite treatment fluid within the wellbore;

introducing the composite treatment fluid into the subterranean formation via a first flowpath; and diverting the composite treatment fluid from the first flowpath into the formation to a second flowpath into the formation.

2. The method of claim 1, wherein one or more of the points of entry comprises a perforation.

3. The method of claim 1, wherein one or more of the point of entry comprises a casing window.

4. The method of claim 1, wherein providing a wellbore having the casing string comprising the plurality of points of entry comprises:

positioning a fluid jetting apparatus within the casing string, wherein the fluid jetting apparatus is attached to a work string;

configuring the fluid jetting apparatus to emit a perforating fluid; and operating the fluid jetting apparatus so as to introduce one or more perforations within the casing string.

5. The method of claim 1, wherein providing a wellbore having the casing string comprising the plurality of points of entry comprises:

shifting a casing window assembly from a first configuration in which the casing window assembly does not provide a route of fluid communication from the casing string to the subterranean formation to a second configuration in which the casing window assembly provides a route of fluid communication from the casing string to the subterranean formation, wherein the casing window assembly is incorporated within the casing string.

6. The method of claim 5, wherein shifting the casing window assembly from the first configuration to the second configuration comprises:

positioning a mechanical shifting tool within the casing string, wherein the mechanical shifting tool is attached to a work string;

actuating the mechanical shifting tool, wherein actuating the mechanical shifting tool causes the mechanical shifting tool to engage a sliding sleeve of the casing window assembly; and moving the sliding sleeve so as to unobscure one or more fluid ports of the casing window assembly.

7. The method of claim 1, wherein forming the composite treatment fluid within the wellbore comprises:

introducing a first fluid component into the wellbore via a first component flowpath into the wellbore;

introducing a second fluid component into the wellbore via a second component flowpath into the wellbore; and mixing the first fluid component and the fluid second component within the wellbore.

8. The method of claim 7, wherein the first component flowpath into the wellbore comprises a flowbore defined by a workstring and the second component flowpath into the wellbore comprises an annular space between the casing string and the workstring.

9. The method of claim 8, wherein the first fluid component comprises a concentrated proppant-laden slurry, wherein the second fluid component comprises a diluent, and wherein the composite treatment fluid comprises a fracturing fluid.

10. The method of claim 1, further comprising monitoring the subterranean formation as the composite treatment fluid is introduced therein.

11. The method of claim 10, wherein the subterranean formation is monitored using microseismic analysis.

12. The method of claim 1, further comprising:

introducing the composite treatment fluid into the subterranean formation via the second flowpath; and diverting the composite treatment fluid from the second flowpath into the formation to a third flowpath into the formation.

13. A method of servicing a subterranean formation comprising:

providing a plurality of points of entry into the subterranean formation associated with a first stage of a well bore servicing operation;

introducing a composite treatment fluid into the subterranean formation via a first of the plurality of points of entry into the formation associated with the first stage;

introducing a diverting fluid into the first of the plurality of points of entry into the formation, wherein introducing a diverting fluid into the first of the plurality of points of entry into the formation associated with the first stage causes the composite treatment fluid to be diverted from the first of the plurality of points of entry associated with the first stage to a second of the plurality of points of entry associated with the first stage; and introducing the composite treatment fluid into the subterranean formation via the second of the plurality of points of entry into the formation associated with the first stage.

14. The method of claim 13, further comprising isolating the plurality of points of entry into the subterranean formation associated with the first stage from a plurality of points of entry into the subterranean formation associated with a second stage.

15. The method of claim 14, further comprising:

introducing a composite treatment fluid into the subterranean formation via a first of the plurality of points of entry into the subterranean formation associated with the second stage; and introducing a diverting fluid into the first of the plurality of points of entry into the formation associated with the second stage, wherein introducing a diverting fluid into the first of the plurality of points of entry into the formation associated with the second stage causes the composite treatment fluid to be diverted from the first of the plurality of points of entry associated with the second stage to a second of the plurality of points of entry associated with the second stage.

16. The method of claim 14, wherein isolating the plurality of points of entry into the subterranean formation associated with the first stage from the plurality of points of entry into the subterranean formation associated with the second stage comprises setting a particulate plug.

17. The method of claim 13, wherein introducing a composite treatment fluid into the subterranean formation comprises forming the composite treatment fluid in a wellbore, wherein forming the composite treatment fluid within the wellbore comprises:

introducing a first fluid component into the wellbore via a first flowpath into the wellbore;

introducing a second fluid component into the wellbore via a second flowpath into the wellbore; and mixing the first fluid component and the second fluid component within the well bore.

18. The method of claim 17, wherein the first flowpath into the wellbore comprises a flowbore defined by a workstring and the second flowpath into the wellbore comprises an annular space between the casing string and the workstring.

19. A method of servicing a subterranean formation comprising:

providing a wellbore penetrating the subterranean formation and having a casing string disposed therein, the casing string comprising a plurality of points of entry, wherein each of the plurality of points of entry provides a route of fluid communication from the casing string to the subterranean formation;

introducing a first fluid component into the wellbore via a first component flowpath into the wellbore;

introducing a second fluid component into the wellbore via a second component flowpath into the wellbore;

mixing the first fluid component and the second fluid component within the wellbore to form a composite treatment fluid;

introducing the composite treatment fluid into the subterranean formation via a first flowpath; and diverting the composite treatment fluid from the first flowpath into the formation to a second flowpath into the formation.

20. The method of claim 19 wherein diverting the composite treatment fluid from the first flowpath into the formation to the second flowpath into the formation comprises introducing a diverting material into the composite treatment fluid via at least one of the first component flowpath into the wellbore or the second component flowpath into the wellbore.

* * * * *